US007416425B2

(12) United States Patent
Murakami et al.

(10) Patent No.: US 7,416,425 B2
(45) Date of Patent: Aug. 26, 2008

(54) LEVER-TYPE CONNECTOR

(75) Inventors: Takao Murakami, Shizuoka (JP); Takanori Yamawaki, Shizuoka (JP); Masao Nagano, Shizuoka (JP); Hiroshi Kobayashi, Aichi (JP); Masato Minakata, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/442,139

(22) Filed: May 30, 2006

(65) Prior Publication Data

US 2007/0020978 A1 Jan. 25, 2007

(30) Foreign Application Priority Data

May 30, 2005 (JP) ..... 2005-157573
Jun. 1, 2005 (JP) ..... 2005-161511

(51) Int. Cl.
*H01R 13/62* (2006.01)

(52) U.S. Cl. ..... 439/157

(58) Field of Classification Search ..... 439/157, 439/155, 489
See application file for complete search history.

(56) References Cited

U.S. PATENT DOCUMENTS 5,344,194 A * 9/1994 Hatagishi et al. ..... 285/26
5,476,391 A * 12/1995 Katsuma ..... 439/157
5,484,297 A * 1/1996 Takahashi et al. ..... 439/157
5,637,003 A * 6/1997 Takahashi ..... 439/157
6,325,647 B1 * 12/2001 May et al. ..... 439/157
6,485,317 B2 * 11/2002 Gundermann et al. ..... 439/157
6,558,176 B1 * 5/2003 Martin et al. ..... 439/157
6,644,992 B2 * 11/2003 Maegawa ..... 439/157
6,679,711 B2 * 1/2004 Takahashi ..... 439/157
6,755,674 B2 * 6/2004 Fujii et al. ..... 439/157
6,793,522 B2 * 9/2004 Yamashita ..... 439/489
6,905,355 B2 * 6/2005 Fukamachi ..... 439/157
6,916,135 B2 * 7/2005 Tanaka ..... 403/322.4
7,004,769 B1 * 2/2006 Putnam et al. ..... 439/157
7,044,758 B2 * 5/2006 Deno et al. ..... 439/157
7,052,293 B2 * 5/2006 Koshy et al. ..... 439/157
2003/0199185 A1 * 10/2003 Fujii et al. ..... 439/157
2005/0245114 A1 * 11/2005 Shiga ..... 439/157

FOREIGN PATENT DOCUMENTS

JP 2002-198127 A 7/2002

* cited by examiner

*Primary Examiner*—Michael C Zarroli
(74) *Attorney, Agent, or Firm*—Sughrue Mion, PLLC

(57) ABSTRACT

A lever-type connector 10 includes female and male connector housings 41 and 11 which have respective connection terminals 50 and 51, and can be fitted together. A lock lever 17 is pivotally supported on the male connector housing 11, and engagement lock projections 46, formed on the female connector housing 41, are engaged with the lock lever 17, and in this condition the lock lever 17 is pivotally moved so as to fit the female and male connector housings 41 and 11 together. The lock lever 17 has at least one projection 27 serving as a contact point at which the lock lever contacts the male connector housing 11.

6 Claims, 15 Drawing Sheets

LEVER-TYPE CONNECTOR

BACKGROUND OF THE INVENTION

1. Field of the Invention

This invention relates to a connector in which countermeasures against vibration are taken, and more particularly to a lever-type connector in which a pair of connector housings are fitted together by pivotally moving a lever.

2. Description of the related art

A connector, used, for example, in the wiring of a vehicle such as an automobile, undergoes vibration developing during the travel of the vehicle, and in some cases contact portions of connection terminals of the connector are worn by such vibration, so that the electrical connection becomes defective. Therefore, there is known a conventional connector in which relative motion between a pair of connector housings, fitted together, is suppressed so as to reduce wear of contact portions of connection terminals which would be caused by the rubbing of these terminals against each other (see, for example, JP-A-2002-198127).

As shown in FIG. 7, the connector 100, disclosed in JP-A-2002-198127, comprises the female connector housing 102 holding the male terminals 103, and the male connector housing 104 receiving the female terminals 101 for electrical connection to the respective male terminals 103. The male connector housing 104 includes an inner housing 106 which holds the female terminals 101, and is fitted into a hood portion 105 of the female connector housing 102, and an outer housing 107 of a generally square tubular shape surrounding an outer periphery of the inner housing 106, the male connector housing 104 being formed into an integral construction.

Limitation projections 108 are formed on an inner peripheral surface of the outer housing 107, and these limitation projections 108 contact an outer peripheral surface of the hood portion 105 of the female connector housing 102 inserted between the outer housing 107 and the inner housing 106. As a result, relative motion of the female and male connector housings 102 and 104 in a direction perpendicular to the direction of fitting of these connector housings is prevented.

However, the limitation projections 108 in the connector 100, disclosed in the above JP-A-2002-198127, could prevent the relative motion between the hood portion 105 of the female connector housing 102 and the outer housing 107 of the male connector housing 104, but could not directly prevent the relative motion between the inner housing 106, holding the female terminals 101, and the female connector housing 102. And besides, the limitation projections 108 could prevent the relative motion of the female and male connector housings 102 and 104 in a direction perpendicular to the fitting direction, but could not prevent the relative motion in the fitting direction. Therefore, there has been a fear that wear of the contact portions of the connection terminals due to the rubbing of these connection terminals can not be sufficiently reduced.

Therefore, the inventors of the present invention have contrived the type of connector in which an outer housing and an inner housing of a male connector housing which are separate from each other are formed, and the inner housing is supported by the outer housing so as to move forward and rearward in a fitting direction, and resilient members, urging the inner housing toward a female connector housing in the fitting direction, are interposed between the inner housing and the outer housing, and inclined surfaces, which are inclined to intersect the fitting direction, and can be mated with each other, are formed respectively on an outer peripheral surface of the inner housing and an inner peripheral surface of a hood portion of the female connector housing in which the inner housing can be fitted.

In the above connector, the inner housing, urged by the resilient members, abuts against the female connector housing. Therefore, the relative motion between the inner housing (holding female terminals) and the female connector housing is directly prevented. Also, the inner housing abuts at the inclined surface (formed at the outer peripheral surface thereof) against the inclined surface formed on the inner peripheral surface of the hood portion of the female connector housing. Since the two inclined surfaces intersect the fitting direction, the relative motion of the inner housing (holding the female terminals) and the female connector housing is prevented both in the fitting direction and in a direction perpendicular to the fitting direction. Therefore, wear of the contact portions of the female and male terminals due to the rubbing of these terminals can be reduced, and therefore a vibration-withstanding performance of the connector is enhanced.

In the above connector, a force, required for fitting the female and male connector housings together, is increased because of provision of the interposed resilient members, and therefore it is preferred to provide a lever for supporting the fitting of the female and male connector housings.

A conventional lever for supporting the fitting of female and male connector housings is pivotally supported on one of the two connector housings, and is engaged with engagement projections formed on the other connector housing, and in this condition the lever is pivotally moved so as to draw the other connector housing, thereby supporting the fitting of the two connector housings. Any lever of this kind functions to reduce an operating force during the fitting operation, using the principle of a lever (leverage).

However, in the conventional lever-type connector provided with such a lever, the lever is supported at its pivot support point, but is free at its portion remote from the support point, and its natural frequency is in a low condition, and is close to a vibration frequency band of a vehicle. Therefore, there is a possibility that this natural frequency coincides with the vibration frequency of the vehicle, so that resonance of the lever occurs, and it is feared that the vibration-withstanding performance of the lever is inadequate. When the two connector housings are disposed in the completely-fitted condition, the lever is usually retained by one of the two connector housings, and therefore is prevented from pivotal movement. However, there is a fear that this retained condition is canceled by the resonance of the lever.

Furthermore, when such a lever is used in the above connector, the resilient forces of the resilient members eventually act so as to disengage the two connector housings from each other, and a load, tending to pivotally move the lever in a direction (returning direction) opposite to the direction of pivotal movement of the lever during the fitting operation of the two connector housings, always acts on the lever through an engagement portion engaged with the female connector housing. Therefore, when the retained condition of the lever is canceled, the lever is instantaneously pivotally moved in the returning direction by the above load. Therefore, when the retained condition of the lever is canceled, for example, by vibration, there is a fear that the resilient forces of the resilient members are greatly reduced, so that the vibration-withstanding performance of the connector is lowered. Furthermore, when the operator inadvertently cancels the retained condition of the lever, there is a fear that the operator hurts his hand.

Also, the limitation projections 108 in the connector 100, disclosed in the above JP-A-2002-198127, could prevent the relative motion of the female and male connector housings 102 and 104 in the direction perpendicular to the fitting direction, but could not prevent the relative motion of these connector housings in the fitting direction. And besides, the limitation projections 108 could prevent the relative motion between the hood portion 105 of the female connector housing 102 and the outer housing 107 of the male connector housing 104, but could not directly prevent the relative motion between the inner housing 106, holding the female terminals 101, and the female connector housing 102. Thus, the vibration-withstanding performance of the connector 100, disclosed in the above Patent Literature 1, was not fully satisfactory.

SUMMARY OF THE INVENTION

This invention has been made in view of the above circumstances, and an object of the invention is to provide a lever-type connector in which its vibration-withstanding performance, reliability and safety are enhanced.

The above object has been achieved by a lever-type connector of the present invention recited in the following Paragraphs (1) to (4).

(1) A lever-type connector comprising a pair of connector housings which have respective connection terminals, and can be fitted together, wherein a lever is pivotally supported on one of the two connector housings, and engagement projections, formed on the other connector housing, are engaged with the lever, and in this condition the lever is pivotally moved so as to fit the pair of connector housings together; characterized in that the lever has at least one contact point at which the lever contacts the one connector housing.

(2) A lever-type connector as defined in the above Paragraph (1), characterized in that the lever includes a pair of opposed side plate portions between which the one connector housing is interposed, and which are pivotally supported at their one end portions on the one connector housing, and an operating portion which interconnects the other end portions of the pair of side plate portions, and can be pivotally operated; and the contact points are disposed respectively on those portions of the pair of side plate portions which are opposed to each other; and the pair of side plate portions hold the one connector housing therebetween at the contact portions.

(3) A lever-type connector as defined in the above Paragraph (1) or Paragraph (2), characterized in that the one connector housing comprises an inner housing which holds the connection terminal, and can be fitted in the other connector housing, an outer housing which surrounds an outer periphery of the inner housing, and supports the inner housing in such a manner that the inner housing can move forward and rearward in a fitting direction, and a resilient member which is interposed between the inner housing and the outer housing to urge the inner housing toward the other connector housing; and the lever is pivotally supported on the outer housing.

(4) A lever-type connector as defined in the above Paragraph (3), characterized in that inclined surfaces, which intersect the fitting direction, and can be mated with each other, are formed respectively on the inner housing and the other connector housing.

In the lever-type connector of the above Paragraph (1), the lever and the one connector housing (which supports this lever) further contact each other at the contact point disposed at a position different from the pivot support point of the lever. With this construction, even if a natural frequency of the lever coincides with a vibration frequency of a vehicle, so that resonance of the lever occurs, the vibration of the lever can be suppressed. Namely, the vibration-withstanding performance of the lever can be enhanced. Here, when the lever is retainingly engaged with one of the pair of connector housings in a completely-fitted condition of the two connector housings, the retaining engagement of the lever is prevented from being canceled by vibration. The larger the distance of the point of contact between the lever and the one connector housing from the pivot support point of the lever is, the higher the vibration-suppressing effect is.

In the lever-type connector of the above Paragraph (2), the pair of side plate portions of the lever holds the one connector housing therebetween, and therefore the lever and the one connector housing are combined together into a generally unitary form. Therefore, both of the natural frequencies of the lever and one connector housing are increased to levels far away from the vibration frequency band of the vehicle, thereby preventing the resonance due to the vehicle vibration. Namely, the vibration-withstanding performance of the lever can be enhanced, and hence the vibration-withstanding performance of the connector can be enhanced.

In the lever-type connector of the above Paragraph (3), the inner housing, urged by the resilient member, abuts against the other connector housing. Therefore, the relative motion between the inner housing (holding the connection terminal) and the other connector housing is directly prevented, so that wear of contact portions of the connection terminals due to the rubbing of these terminals can be reduced. Namely, the vibration-withstanding performance of the connector can be enhanced.

Furthermore, there is provided the lever for supporting the fitting of the inner housing and the other connector housing, and therefore an operating force during the fitting operation can be reduced even though the force, required for the fitting operation, is increased because of the provision of the resilient member.

Furthermore, the pair of side plate portions of the lever hold the outer housing therebetween, and therefore frictional forces, preventing the pivotal movement of the lever, develop at the contact points formed respectively on the side plate portions. Therefore, even when the retaining engagement of the lever is canceled, the pivotal movement of the lever in a returning direction can be limited against the resilience force of the resilient member. Therefore, the reliability of the connector can be enhanced without reducing the resilient force of the resilient member. And besides, the stability of the operation can be enhanced without troubling the operator.

In the lever-type connector of the above Paragraph (4), the inner housing, urged by the resilient member, abuts at its inclined surface against the inclined surface of the other connector housing, and is fixed to the other connector housing. The two inclined surfaces intersect the fitting direction, and therefore the relative motion between the inner housing (holding the connection terminal) and the other connector housing is prevented both in the fitting direction and in a direction perpendicular to the fitting direction, so that wear of the contact portions of the connection terminals due to the rubbing of these terminals can be reduced. Namely, the vibration-withstanding performance of the connector can be enhanced.

Also, this invention has been made in view of the above circumstances, and an object of the invention is to provide a connector in which the vibration-withstanding performance is enhanced.

The above object has been achieved by a connector of the present invention recited in the following Paragraphs (5) to (7).

(5) A connector characterized in that the connector comprises a female connector housing holding a male terminal, and a male connector housing receiving a female terminal for electrical connection to the male terminal; and the male connector housing comprises a male-type inner housing which holds the female terminal, and can be fitted in the female connector housing so that the female terminal can be connected to the male terminal, an outer housing which surrounds an outer periphery of the inner housing, and supports the inner housing in such a manner that the inner housing can move forward and rearward in a fitting direction, and a first resilient member which is interposed between the inner housing and the outer housing to urge the inner housing forward in the fitting direction; and a movable member is mounted on an outer peripheral surface of the inner housing so as to move forward and rearward in the fitting direction, and a second resilient member is mounted on the outer peripheral surface of the inner housing, and urges the movable member forward in the fitting direction by an urging force different from an urging force of the first resilient member; and inclined surfaces, inclined to intersect the fitting direction, are formed on the movable member and that portion of the outer peripheral surface of the inner housing, disposed on the same periphery as the periphery of the movable member, and are arranged over the entire periphery; and inclined surfaces, which are mated respectively with the inclined surfaces formed on the movable member and the outer peripheral surface of the inner housing, are formed on an inner peripheral surface of the female connector housing over an entire periphery thereof.

(6) A connector as defined in the above Paragraph (5), characterized in that the inclined surfaces, formed on the movable member and the outer peripheral surface of the inner housing, are disposed on the outer periphery surrounding a contact point of the female terminal.

(7) A connector as defined in the above Paragraph (5) or Paragraph (6), characterized in that the second resilient member, urging the movable member, is an elastic seal member which is interposed between the outer peripheral surface of the inner housing and the inner peripheral surface of the female connector housing to form a seal therebetween; and the elastic seal member is disposed rearwardly of the inclined surfaces, formed on the movable member and the outer peripheral surface of the inner housing, in the fitting direction.

The inventors of the present invention have made this invention through the following circumstances.

First, the inventors of the present invention have contrived the type of connector in which an outer housing and an inner housing of a male connector housing which are separate from each other are formed, and the inner housing is supported by the outer housing so as to move forward and rearward in a fitting direction, and resilient members, urging the inner housing toward a female connector housing in the fitting direction, are interposed between the inner housing and the outer housing, and inclined surfaces, which are inclined to intersect the fitting direction, and can be mated with each other, are formed respectively on an outer peripheral surface of the inner housing and an inner peripheral surface of a hood portion of the female connector housing (in which the inner housing can be fitted) over their respective entire peripheries.

In the connector of the above construction, the inner housing, urged by the resilient members, is contacted at the inclined surface (formed at the outer peripheral surface thereof) with the inclined surface formed on the inner peripheral surface of the hood portion of the female connector housing, and is fixed to the female connector housing. Since the two inclined surfaces intersect the fitting direction, relative motion of the inner housing (holding female terminals) and the female connector housing is prevented both in the fitting direction and in a direction perpendicular to the fitting direction. Therefore, a vibration-withstanding performance of the connector is enhanced.

However, the female and male connector housings are usually formed by injection molding a resin material, and the two inclined surfaces are formed integrally respectively on the female connector housing and the inner housing during the injection molding. Therefore, there are occasions when a dimensional error due to molding distortion (such as sink and warp) develops in the two inclined surfaces. Therefore, it is not easy to contact the two inclined surfaces with each other over their entire areas over the entire periphery, and there has been a fear that in a region where the two inclined surfaces are not held in contact with each other, relative motion, corresponding to this gap, can develop in that direction, and there has been a fear that contact points are worn by vibration developing in this direction.

Therefore, in the connector of the above Paragraph (1), the inclined surfaces of the inner housing are formed on both of the outer peripheral surface of the inner housing and the movable member which is mounted on this outer peripheral surface so as to move forward and rearward in the fitting direction, and is urged forward in the fitting direction by the second resilient member. Even when a dimensional error develops in the inclined surfaces (formed on the outer peripheral surface of the inner housing) and the inclined surfaces (formed on the inner peripheral surface of the female connector housing), so that the mating inclined surfaces fail to fully contact each other over their entire areas, thus reducing the area of contact therebetween, the inclined surfaces, formed on the movable member, never fail to contact the respective inclined surfaces formed on the inner peripheral surface of the female connector housing, thereby compensating for the reduced contact area. Therefore, the relative motion between the female connector housing and the inner housing is positively prevented, so that wear of the contact points of the female and male terminals due to vibration can be reduced.

In the connector of the above Paragraph (2), the operation for preventing the relative motion between the female connector housing and the inner housing is effected in the vicinity of the contact points of the female and male terminals, and therefore wear of the contact points of the female and male terminals due to vibration can be more positively reduced.

In the connector of the above Paragraph (3), the elastic seal member is disposed rearwardly of the inclined surfaces (for preventing the relative motion) in the fitting direction, that is, disposed at the inner region remote from an open end of the outer housing, and therefore damage to the elastic seal member, as well as the deposition of foreign matters on the elastic seal member, can be reduced, thereby enhancing the sealing performance of the elastic seal member.

In the present invention, there can be provided the lever-type connector in which its vibration-withstanding performance, reliability and safety are enhanced.

As described above, in the present invention, there can be provided the connector in which the vibration-withstanding performance is enhanced.

DESCRIPTION OF THE PREFERRED EMBODIMENTS

A preferred embodiment of the present invention will now be described in detail with reference to the drawings.

Figure 1:
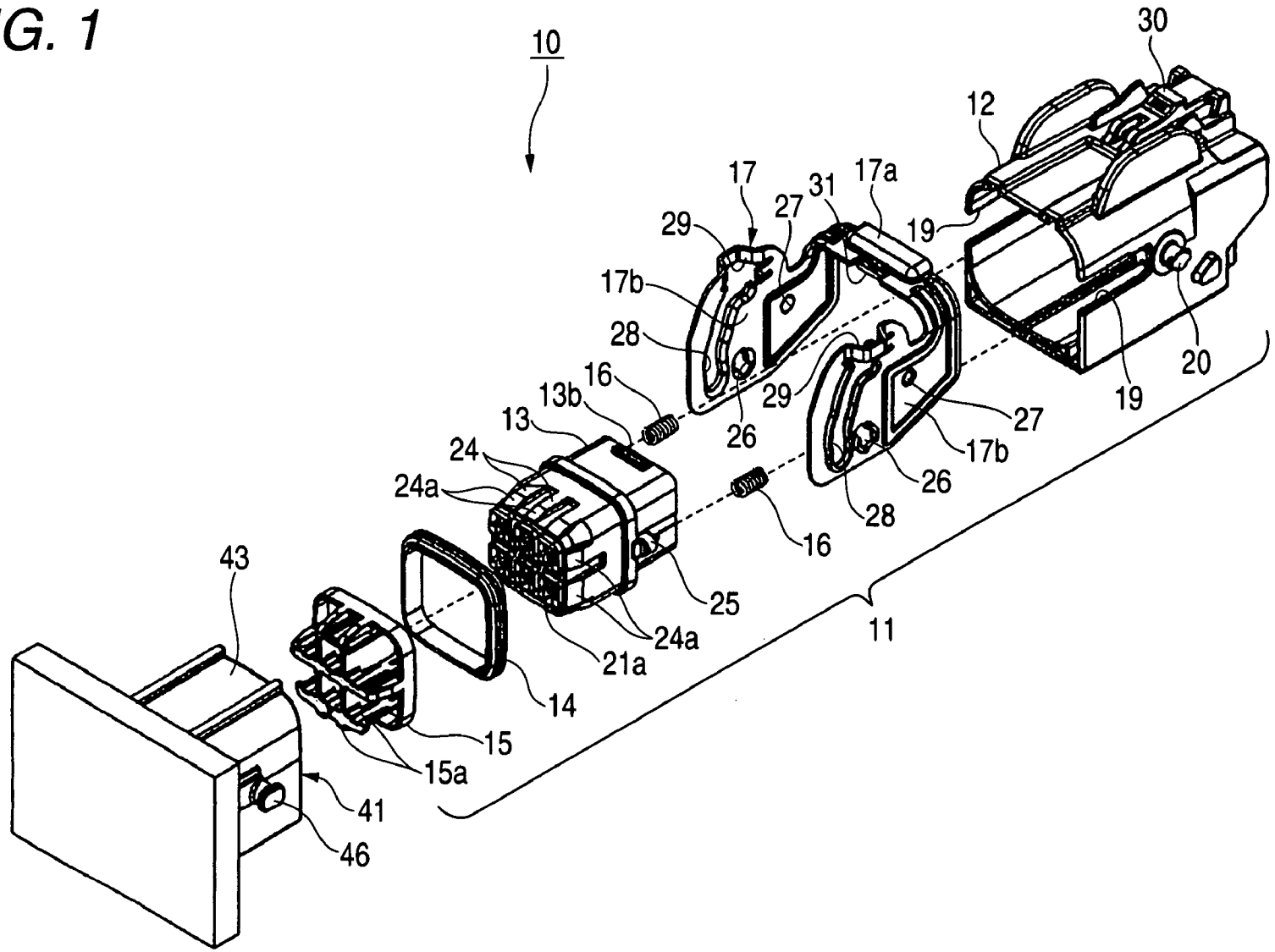
FIG. 1 is an exploded, perspective view of one preferred embodiment of a lever-type connector of the present invention.
Figure 2:
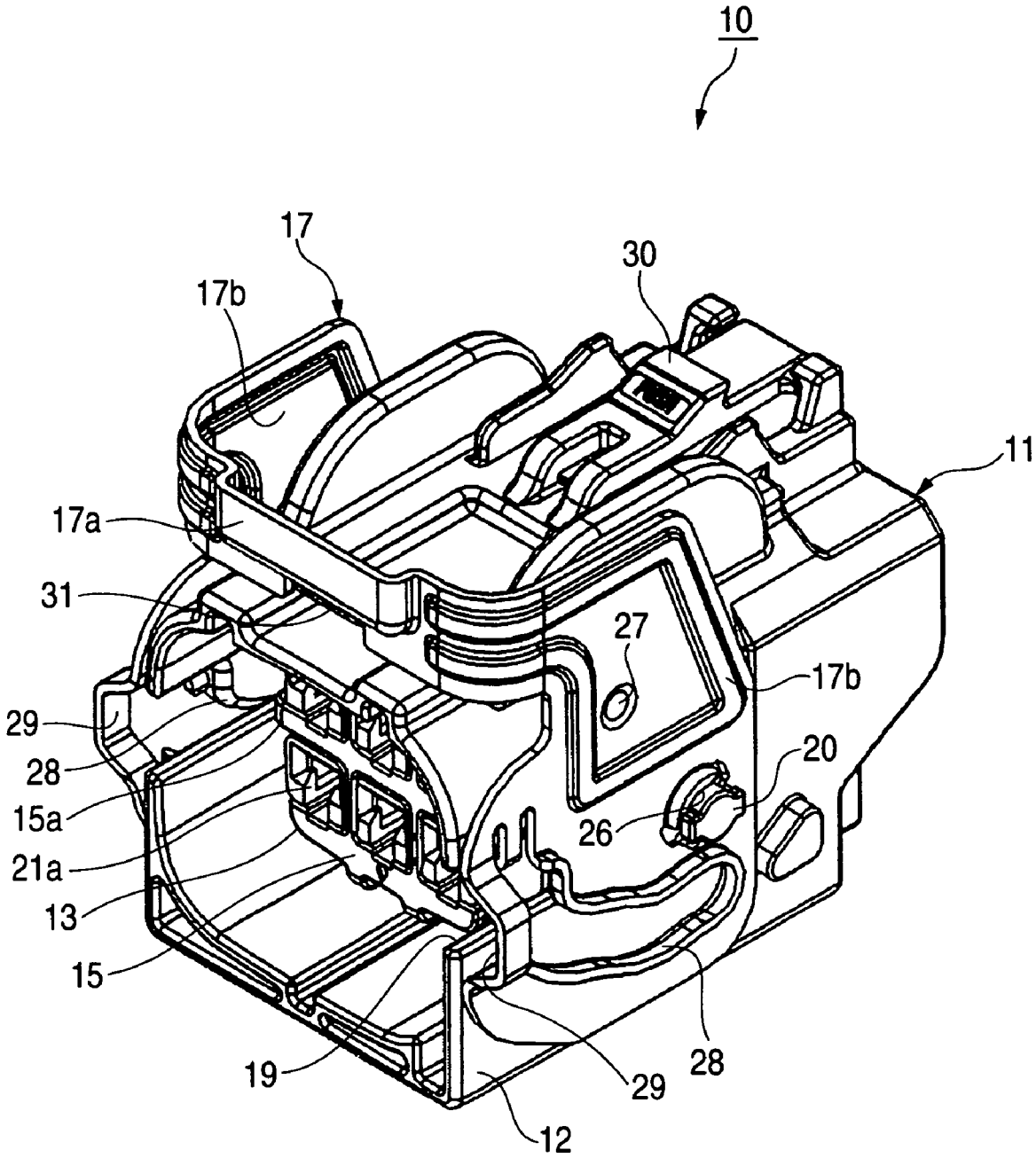
FIG. 2 is a perspective view of a male connector housing of the lever-type connector of FIG. 1 on which a lever is mounted.
Figure 3:
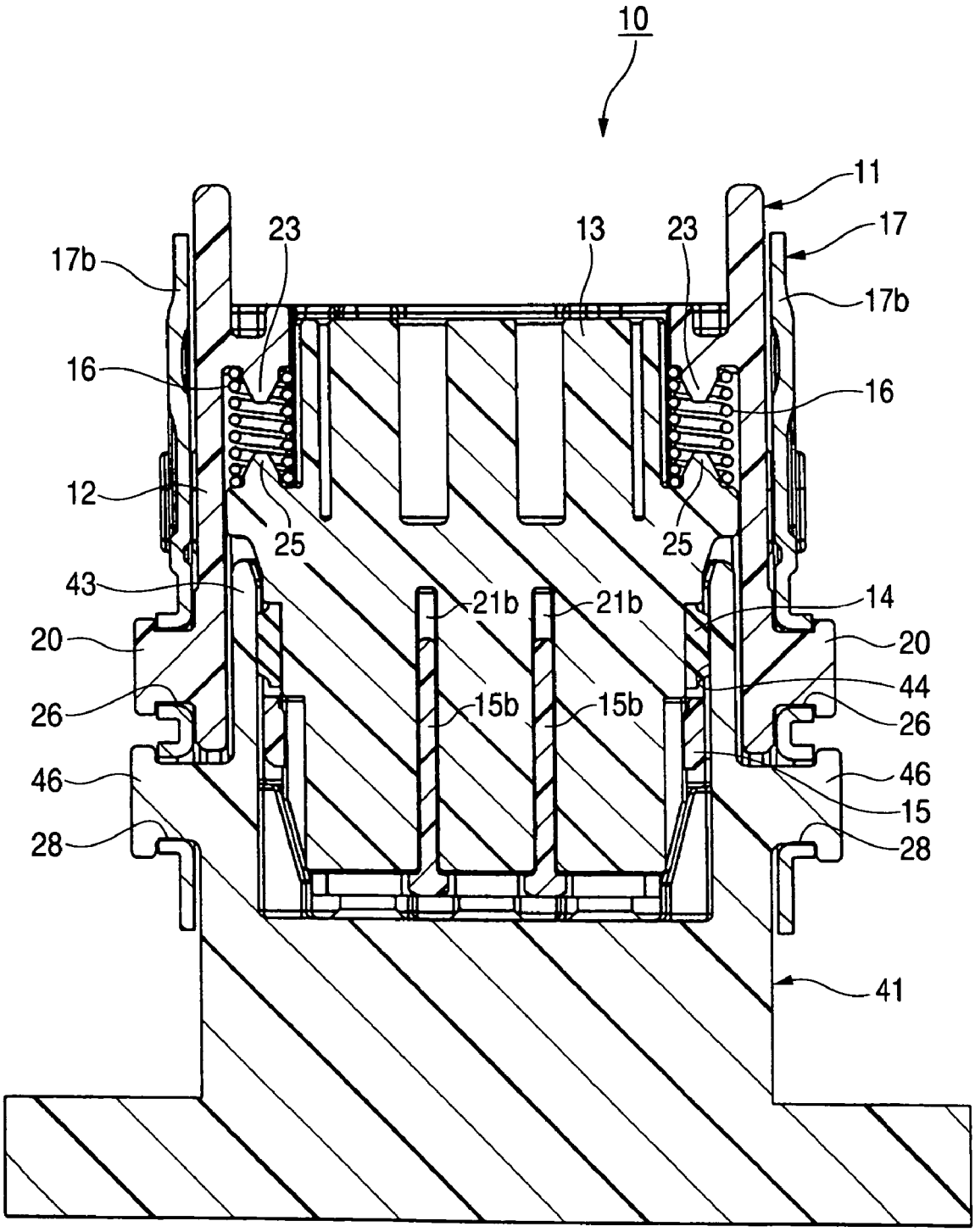
FIG. 3 is a horizontal cross-sectional view of the lever-type connector of FIG. 1.
Figure 4:
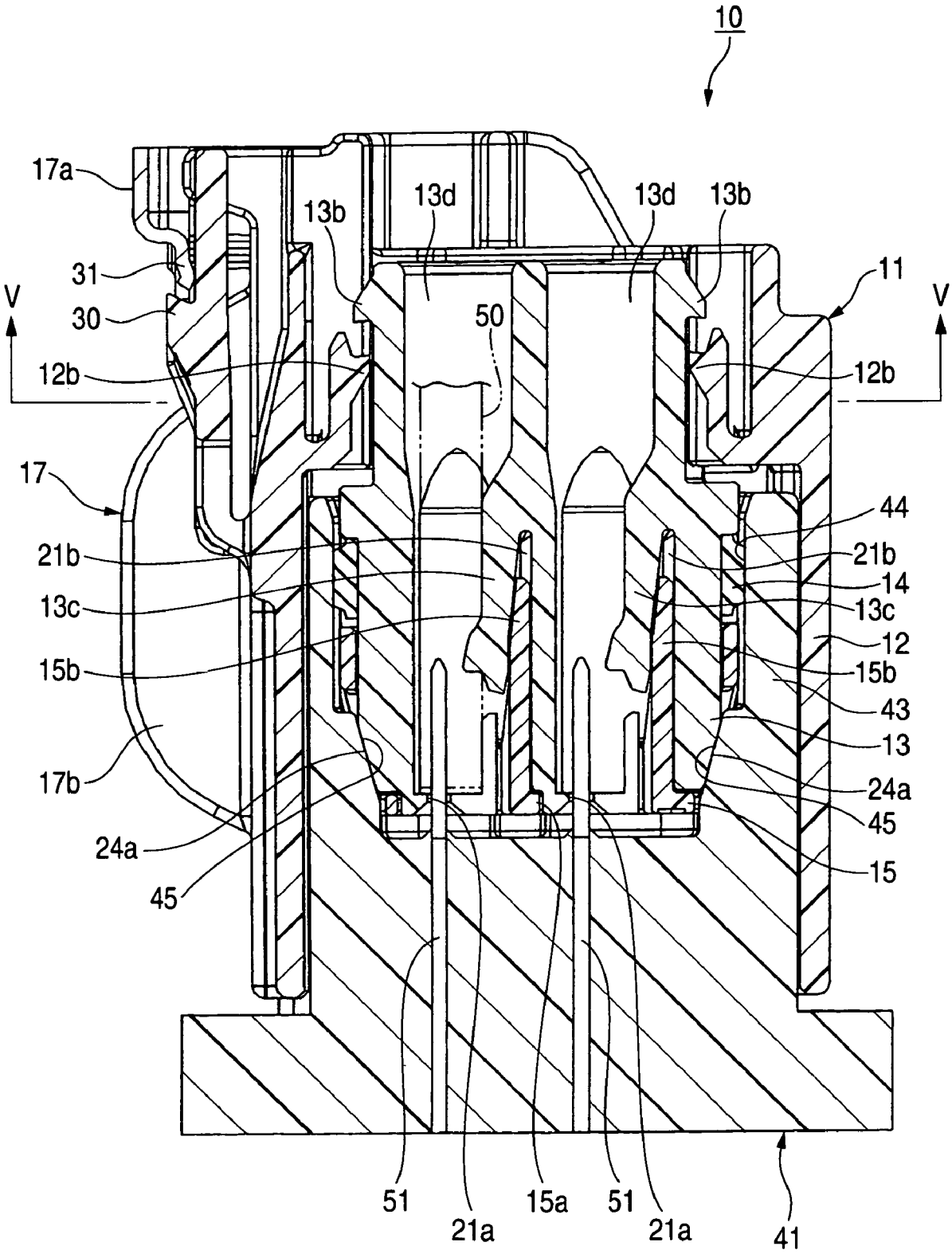
FIG. 4 is a vertical cross-sectional view of the lever-type connector of FIG. 1.
Figure 5:
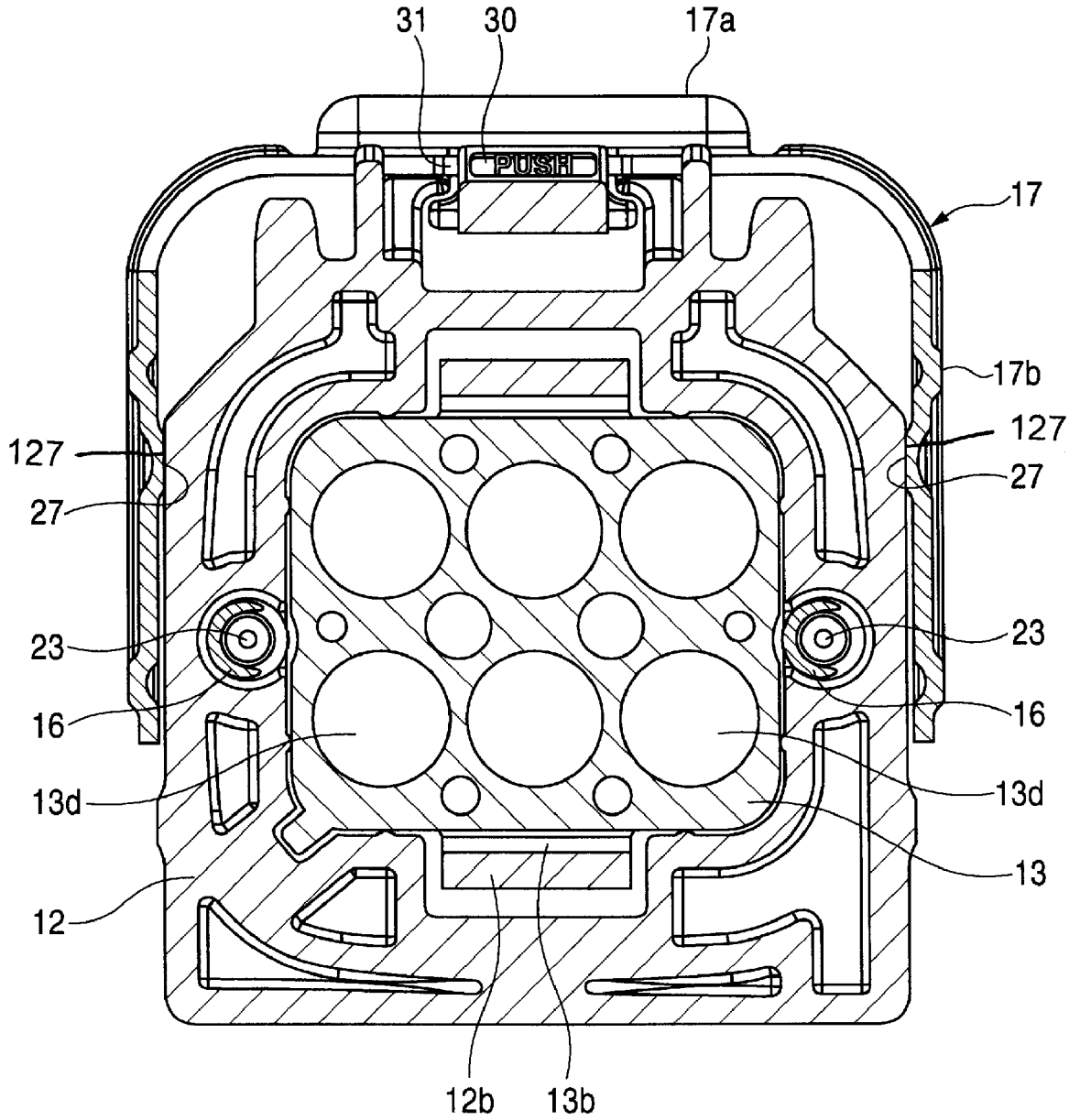
FIG. 5 is a cross-sectional view taken along the line V-V of FIG. 4.

FIG. 1 is an exploded, perspective view of one preferred embodiment of a lever-type connector of the invention, FIG. 2 is a perspective view of a male connector housing of the lever-type connector of FIG. 1 on which a lever is mounted, FIG. 3 is a horizontal cross-sectional view of the lever-type connector of FIG. 1, FIG. 4 is a vertical cross-sectional view of the lever-type connector of FIG. 1, and FIG. 5 is a cross-sectional view taken along the line V-V of FIG. 4.

As shown in FIG. 1, the lever-type connector 10 comprises the male connector housing 11, and a female connector housing 41 which can be fitted to the male connector housing 11.

The male connector housing 11 has the lock lever 17 pivotally supported thereon by pivot shafts 20 and 20 formed on the male connector housing 11. The lock lever 17 is a connector fitting/disengaging operation support member, and when the lock lever 17, engaged with engagement lock projections 46 and 46 of the female connector housing 41, is pivotally moved about the pivot shafts 20 and 20, this lock lever 17 causes the male and female connector housings 11 and 41 to be easily fitted together or withdrawn from each other with a low force, using the principle of a lever (leverage). Also, the lock lever 17 can lock the male and female connector housings 11 and 41 in a completely-fitted condition.

The male connector housing 11 comprises an outer housing 12, and the male-type inner housing 13 supported by the outer housing 12 so as to move forward and rearward in a connector fitting direction within the outer housing 12.

Referring to FIG. 4, the inner housing 13 has terminal receiving chambers 13*d* formed therein for respectively receiving female terminals 50. Each female terminal 50, received in the terminal receiving chamber 13*d*, is provisionally retained by an elastic retaining lance 13*c* formed within the terminal receiving chamber 13*d*, and is held in this chamber 13*d*.

The male connector housing 11 further comprises a front holder 15 for completely retaining the female terminals 50 (provisionally retained in the respective terminal receiving chambers 13*d*) in the respective terminal receiving chambers 13*d*, an annular rubber packing 14, and a pair of metal coil springs 16 and 16. On the other hand, the female connector housing 41 holds male terminals 51.

Here, for convenience of explanation, the front and rear sides, the upper and lower sides and the right and left sides will be defined as follows. The forward-rearward direction is defined as the connector fitting direction, and the fitting ends of the male and female connector housings 11 and 41 are defined as "the front side", while the other ends thereof are defined as "the rear side". The direction of juxtaposition of the pivot shafts 20, as well as the direction of juxtaposition of the engagement lock projections 46, is defined as the right-left direction. That side where an operating portion 17*a* of the lock lever 17 is disposed is defined as "the upper side", while the opposite side is defined as "the lower side".

The outer housing 12 as well as the inner housing 13 is formed by injection molding a synthetic resin material. As shown in FIGS. 1 and 2, the outer housing 12 is formed into a generally square tubular shape, and is open at its front side. The inner housing 13 is disposed within the outer housing 12 so as to move forward and rearward in the connector fitting direction. An outer peripheral wall of a front portion of the outer housing 12 surrounds the inner housing 13 over an entire periphery thereof, with a gap formed therebetween, and functions as a hood for guiding a hood portion 43 of the female connector housing 41 fitted into this annular gap.

As shown in FIGS. 1 and 4, the inner housing 13 has a pair of engagement projections 13*b* formed respectively on upper and lower portions of a rear end portion of an outer peripheral surface thereof. On the other hand, the outer housing 12 has a pair of cantilever-like retaining projections 12*b* formed on and extending rearwardly respectively from upper and lower portions of an inner peripheral surface of a rear portion thereof. The engagement projections 13*b* of the inner housing 13 are retained respectively by the retaining projections 12*b* within the outer housing 12, so that the inner housing 13 is prevented from moving forward relative to the outer housing 12 in an amount exceeding a predetermined value. Thus, the male connector housing 11 has a forward-withdrawal prevention mechanism (that is, the engagement projections 13*b* and the retaining projections 12*b*) for preventing the forward withdrawal of the inner housing 13 from the outer housing 12 in the connector fitting direction.

As shown in FIG. 1, slit-like lock projection-receiving portions 19 are formed respectively in opposed right and left side portions of the outer peripheral wall of the outer housing 12, and extend in the connector fitting direction. The pivot shafts 20 are formed integrally on the outer peripheral wall of the outer housing 12, and are disposed respectively on lines of extension of the lock projection-receiving portions 19. As shown in FIG. 3, spring support portions 23 and 23 for respectively supporting rear end portions of the pair of coil springs 16 and 16 are formed respectively on right and left side portions of the inner peripheral surface of the rear portion of the outer housing 12.

As shown in FIGS. 2 and 4, a plurality of receiving chamber openings 21*a* for being aligned respectively with male terminal insertion holes 15*a* in the front holder 15 are formed in the front surface of the inner housing 13, and also insertion holes 21*b* for respectively receiving partition plate portions

15*b* of the front holder 15 are formed in the front surface of the inner housing 13. The receiving chamber openings 21*a* of the inner housing 13 communicate respectively with the terminal receiving chambers 13*d*. When the male connector housing 11 and the female connector housing 41 are fitted together, an electrical contact portion of each of the male terminals 51 of the female connector housing 41 is guided into the corresponding terminal receiving chamber 13*d* through the corresponding male terminal insertion hole 15*a* of the front holder 15 and the corresponding receiving chamber opening 21*a* of the inner housing 13, and is brought into contact with an electrical contact portion of the female terminal 50 disposed within this terminal receiving chamber 13*d*, and therefore is electrically connected thereto.

As shown in FIG. 1, a plurality of relative motion limitation portions 24 are formed on and project from the outer peripheral surface of a front portion of the inner housing 13, and are spaced from one another in the direction of the periphery thereof. The relative motion limitation portions 24 have respective inclined surfaces 24*a* each inclined from its rear end toward its front end in a manner to gradually approach an axis of the inner housing 13. When the male connector housing 11 and the female connector housing 41 are completely fitted together, the inclined surfaces 24*a* are held in surface-to-surface contact with respective inclined surfaces 45 formed on an inner peripheral surface of the hood portion 43 of the female connector housing 41, as shown in FIG. 4.

As shown in FIG. 3, spring support portions 25 and 25 for respectively supporting front end portions of the pair of coil springs 16 and 16 are formed at the rear portion of the inner housing 13, and are so disposed as to be opposed respectively to the spring support portions 23 and 23 of the outer housing 12.

The rubber packing 14 is molded of synthetic rubber, an elastomeric resin or the like, and is formed into a generally elliptic tubular shape. As shown in FIG. 1, this rubber packing 14 is mounted on that portion of the inner housing 13 disposed rearwardly of the relative motion limitation portions 24, and is retained by the front holder 15 against forward withdrawal.

The lock lever 17 forms, together with the pivot shafts 20 and 20 and the engagement lock projections 46 and 46, a connector fitting/disengaging operation support mechanism, and is made of metal, a synthetic resin or any other suitable material. As shown in FIGS. 1 to 5, the lock lever 17 includes the operating portion 17*a*, and side plate portions 17*b* and 17*b* bent generally perpendicularly respectively at opposite (right and left) ends of the operating portion 17*a*, and this lock lever 17 has a generally U-shaped cross-section. The outer housing 12 is interposed between the side plate portions 17*b* and 17*b* of the lock lever 17.

The operating portion 17*a* has a retaining engagement portion (or point) 31 for retaining engagement with a retaining portion 30 formed on an upper portion of the outer peripheral surface of the rear portion of the outer housing 12. Each of the side plate portions 17*b* includes a mounting hole 26 rotatably (or angularly movably) fitted on the corresponding pivot shaft 20 of the outer housing 12, a projection 27 projecting inwardly so as to serve as a point of contact with the side surface of the outer housing 12, and a generally arcuate lock groove 28.

The projection 27, formed on each side plate 17*b*, is disposed in a generally middle point of the distance between the mounting hole 26 and the retaining engagement point 31, and the two projections 27, formed respectively on the pair of side plate portions 17*b*, are opposed to each other. The distance between the two projections 27 and 27 is smaller than the width of the outer peripheral wall of the outer housing 12 (interposed between the pair of side plate portions 17*b* and 17*b*) in the right-left direction. Therefore, as shown in FIG. 5. the pair of side plate portions 17*b* and 17*b* grip connector housing contact points 127 of the outer housing 12 at the projections 27 and 27, which are examples of lever contact points.

The lock grooves 28 are open at their one longitudinal ends so that the engagement lock projections 46, formed respectively on the right and left side surfaces of the hood portion 43 of the female connector housing 41, can be easily inserted into these lock grooves 28, respectively. More specifically, in order that each engagement lock projection 46 can be easily inserted into the corresponding lock groove 28, a lock projection introduction port 29 is formed by bulging part of each side plate portion 17*b* outwardly, and is disposed in communication with the open end of the lock groove 28.

The female connector housing 41 has a connector fitting chamber 44 of a closed-bottom tube-shape formed within the hood portion 43, the connector fitting chamber 44 having an open front side. The tapering inclined surfaces 45 are formed on the inner peripheral surface of the hood portion 43 forming the connector fitting chamber 44, and each of the inclined surfaces 45 is inclined from its front end toward its rear end in a manner to gradually approach an axis of the female connector housing 41. When the male connector housing 11 and the female connector housing 41 are fitted together, the inclined surfaces 45 abut respectively against the inclined surfaces 24*a* of the relative motion limitation portions 24 of the inner housing 13. The inclined surfaces 45 are formed on the inner peripheral surface of the hood portion 43 (which forms the connector fitting chamber 44) at the same inclination angle as the inclination angle of the inclined surfaces 24*a*.

Next, a method of assembling the male connector housing 11 will be described. The female connector housing 41 can be formed by insert molding the male terminal 51 in a housing body, and therefore a detailed description of its assembling method will be omitted. However, suitable terminal receiving chambers may be formed within the female connector housing 41, in which case male terminals 51 are retained by suitable retaining means such as elastic retaining lances formed within the respective terminal receiving chambers.

The male connector housing 11 is assembled in the following manner. The rubber packing 14 is mounted on the front portion of the inner housing 13 having the female terminals 50 received in the respective terminal receiving chambers 13*d*, and the front holder 15 is attached to the inner housing 13 in such a manner that the partition plate portions 15*b* of the front holder 15 are inserted into the respective insertion holes 21*b* of the inner housing 13. As a result of attaching the front holder 15 to the inner housing 13, the female terminals 50 are retained in a double manner within the respective terminal receiving chambers 13*d*, and also the rubber packing 14 is prevented from forward withdrawal from the inner housing 13.

Then, the front end portions of the coil springs 16 are attached respectively to the spring support portions 25 from the rear side of the inner housing 13, and the inner housing 13 is fitted into the outer housing 12 in such a manner that the rear end portions of the coil springs 16 are attached respectively to the spring support portions 23 of the outer housing 12.

Then, the inner housing 13 is pushed deeper into the outer housing 12 against the resiliency (that is, resilient restoring forces) of the coil springs 16, and when the engagement projections 13*b* of the inner housing 13 are engaged respectively with the retaining projections 12*b* of the outer housing 12, the coil springs 16 are held between the inner housing 13 and the outer housing 12. In this manner, the inner housing 13 is mounted within the outer housing 12. When the inner housing 13 and the outer housing 12 are thus completely assembled together, the coil springs 16 may or may not be compressed by the inner housing 13 and the outer housing 12.

Then, the lock lever 17 is moved close to the rear side of the outer housing 12, and when the outer housing 12 is inserted between the pair of side plate portions 17*b* and 17*b* of the lock lever 17 (in such a manner that the outer housing 12 is interposed between the side plate portions 17*b* and 17*b*), end edges of the side plate portions 17*b* and 17*b* abut respectively against the pivot shafts 20 and 20, and the side plate portions 17*b* and 17*b* are temporarily bent outwardly, and when the mounting holes 26 and 26 are brought into registry with the right and left pivot shafts 20 and 20, the pivot shafts 20 and 20 become engaged in the respective mounting holes 26 and 26. The lock lever 17 is thus mounted on the outer housing 12, so that the assembling of the male connector housing 11 is finished.

The lock lever 17 is thus mounted on the outer housing 12 so as to be pivotally moved about the pivot shafts 20 in the forward and rearward directions. The lock lever 17 can be switched between an unlocked position (shown in FIGS. 2 and 6A) where the operating portion 17*a* is disposed in an upstanding condition, that is, the plane of the operating portion 17*a* is disposed generally perpendicular to the upper surface of the outer housing 12 and a locked position (shown in FIGS. 4 and 6B) where the operating portion 17*a* a is disposed in a rearwardly-downed condition, that is, the plane of the operating portion 17*a* is disposed generally parallel to the upper surface of the outer housing 12.

Figure 6:
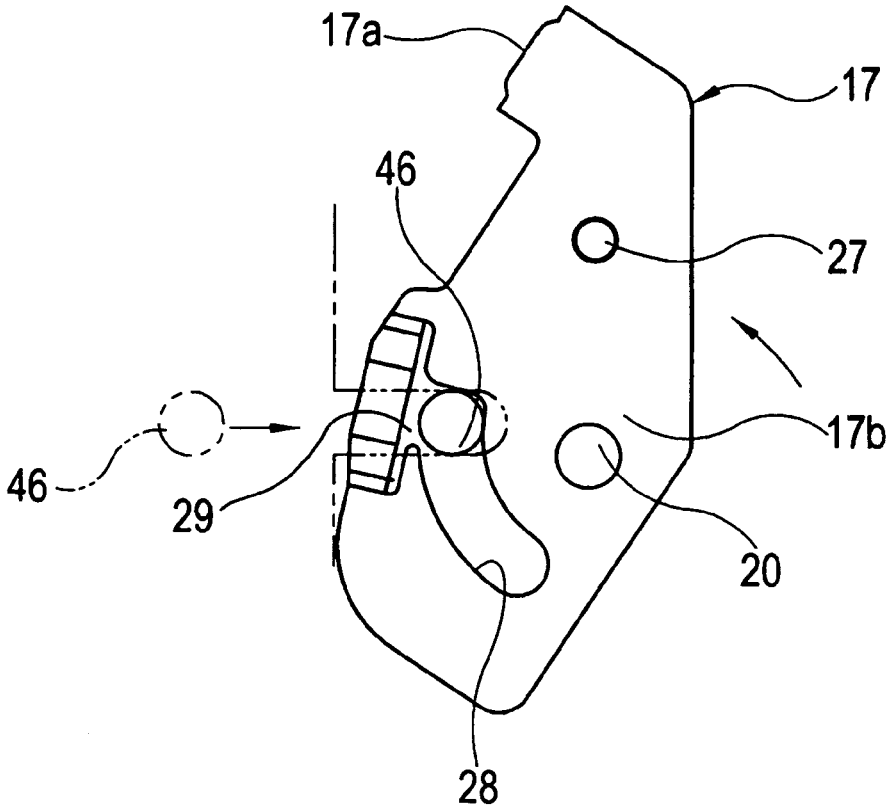
FIGS. 6A and 6B are views explanatory of an operation of a fitting/disengaging operation support mechanism of the lever-type connector of FIG. 1.
Figure 6:
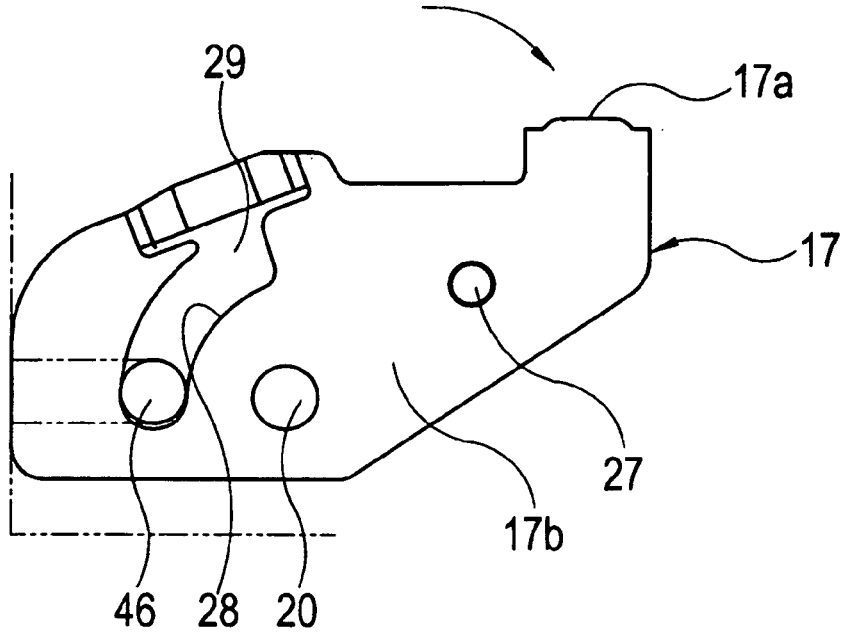
Figure 7:
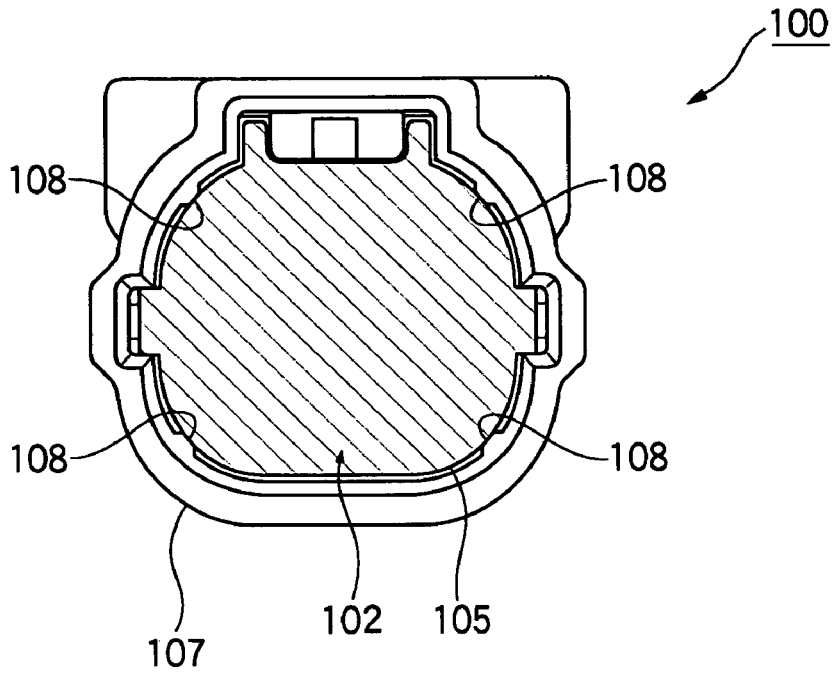
FIG. 7A is a transverse cross-sectional view of a conventional connector.
FIG. 7B is a longitudinal cross-sectional view of the connector of FIG. 7A.
Figure 7:
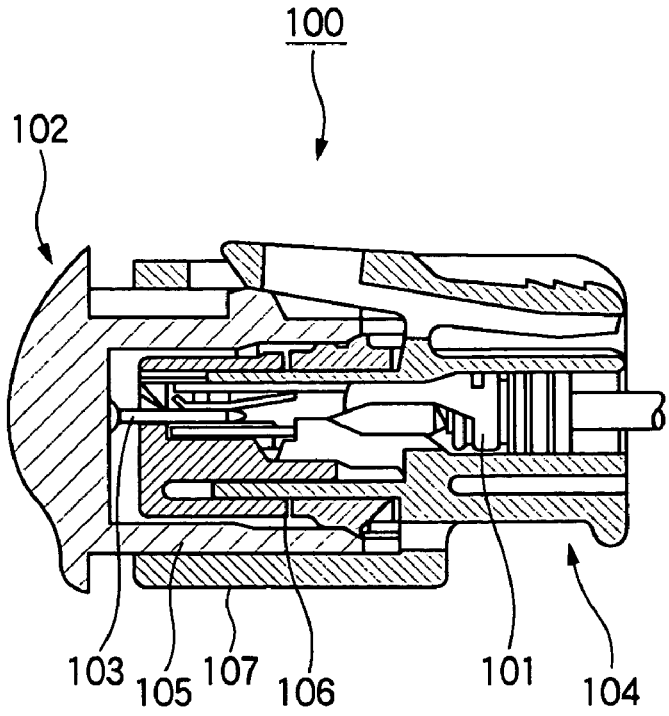

FIGS. 6A and 6B are views explanatory of the operation of the fitting/disengaging operation support mechanism of the lever-type connector 10. As is clear from FIG. 6A, when the lock lever 17 is disposed in the upstanding condition, that is, in the unlocked position, each lock projection introduction port 29 is open forward, that is, toward the female connector housing 41 when the male connector housing 11 and the female connector housing 41 are to be fitted together.

Next, a method of fitting the connector 10 will be described.

The lock lever 17 of the male connector housing 11 is disposed in the unlocked position as shown in FIG. 6A, and in this condition, when the hood portion 43 of the female connector housing 41 is fitted into the annular space between the outer housing 12 and the inner housing 13, the inner housing 13 is also fitted into the connector fitting chamber 44 of the female connector housing 41. At this time, the engagement lock projections 46 of the female connector housing 41 enter the respective lock projection-receiving portions 19 of the outer housing 12, and then are brought into the open ends of the respective lock grooves 28 through the respective lock projection introduction ports 29. FIG. 6A shows this condition, and the male connector housing 11 and the female connector housing 41 are disposed in a half-fitted condition.

Then, when the lock lever 17 is pivotally moved about the pivot shafts 20 by pushing the operating portion 17*a* rearwardly, and therefore is turned from the unlocked position (shown in FIG. 6A) toward the rear locked position, each engagement lock projection 46, while guided by the corresponding lock groove 28, moves in and along this lock groove 28 from the open end thereof toward the other end thereof, so that the operation for fitting the male and female connector housings 11 and 41 together proceeds. At this time, the inclined surfaces 45, provided at the inner portion of the connector fitting chamber 44, abut against the respective inclined surfaces 24*a* of the relative motion limitation portions 24 of the inner housing 13. In this condition, the operating portion 17*a* is further pushed rearwardly to pivotally move the lock lever 17, and when the lock lever 17 reaches the locked position shown in FIG. 6B, the male connector housing 11 and the female connector housing 41 are completely fitted together, and within these connector housings, the inclined surfaces 24*a* are pressed by the respective inclined surfaces 45, and the coil springs 16 are compressed.

In this connector completely-fitted condition, the male connector housing 11 and the female connector housing 41 are locked to each other against disengagement by the connector fitting/disengaging operation support mechanism including the lock lever 17, and this fitted condition is maintained, and therefore the inclined surfaces 45 of the female connector housing 41 are urged by the resilient restoring forces of the coil springs 16 through the respective inclined surfaces 24*a* of the relative motion limitation portions 24, and are kept in intimate contact with the respective inclined surfaces 24*a* (In other words, there is maintained a condition in which the inclined surfaces 24*a*, disposed in surface-to-surface contact with the respective inclined surfaces 45, are pressed against the respective inclined surfaces 45 by the resilient restoring forces of the coil springs 16.). Furthermore, in this connector completely-fitted condition, the flat plate-shaped electrical contact portions of the male terminals 51 are inserted respectively in the box-shaped electrical contact portions of the female terminals 50, and the electrical contact portions of the female terminals 50 are electrically connected respectively to the electrical contact portions of the male terminals 51. Furthermore, in this connector completely-fitted condition, the rubber packing 14 is held between (or gripped by) the inner peripheral surface (forming the connector fitting chamber 44) of the female connector housing 41 and the outer peripheral surface of the inner housing 13, and forms a liquid-tight seal between this inner peripheral surface and this outer peripheral surface.

In the connector completely-fitted condition, the projections 27 and 27, formed respectively on the side plate portions 17*b* and 17*b* of the lock lever 17, are held in contact with the right and left side portions of the outer peripheral surface of the outer housing 13, and the pair of side plate portions 17*b* and l7*b* hold the outer housing 12 therebetween. Also, the retaining engagement point 31, provided at the operating portion 17*a* of the lock lever 17, is retainingly engaged with the retaining portion 30 of the outer housing 12, so that the lock lever 17 is prevented from being pivotally moved in a direction opposite to the direction of pivotal movement of the lock lever 17 during the fitting operation.

With respect to the operation for disengaging the male connector housing 11 and the female connector housing 41 from each other, the retaining engagement of the retaining engagement point 31 of the operating portion 17*a* with the retaining portion 30 of the outer housing 12 is canceled, and then the lock lever 17 is pivotally moved in the direction opposite to the direction of pivotal movement of the lock lever 17 during the fitting operation, thereby effecting this connector disengaging operation. Here, the resilient forces of the coil springs 16 and 16 eventually act so as to disengage the outer housing 12 from the female connector housing 41, and a load, tending to pivotally move the lock lever 17 in the direction (returning direction) opposite to the direction of pivotal movement of the lock lever 17 during the fitting operation, always acts on the lock lever 17 through the engagement lock projections 46 and 46. On the other hand, in the connector completely-fitted condition, the pair of side plate portions 17*b* and 17*b* hold the outer housing 12 therebetween, and a frictional force develops between each of the projections 27 and 27 and the outer peripheral surface of the outer housing 12, and these frictional forces serve to prevent the lock lever 17 from being pivotally moved in the returning direction.

In the lever-type connector 10 of this embodiment, the lock lever 17 and the outer housing 12 further contact each other at the positions different from the mounting holes 26 of the lock lever 17. With this-construction, even if the natural frequency of the lock lever 17 coincides with a vibration frequency of a vehicle, so that resonance of the lock lever occurs, the vibration of the lock lever 17 can be suppressed, and the retaining engagement of the retaining engagement point 31 of the lock lever 17 is prevented from being canceled. Namely, the vibration-withstanding performance of the lock lever 17 can be enhanced.

And besides, in the lever-type connector 10 of this embodiment, the pair of side plate portions 17*b* and 17*b* of the lock lever 17 holds the outer housing 12 therebetween, and therefore the lock lever 17 and the outer housing 12 are combined together into a generally unitary form. Therefore, both of the natural frequencies of the lock lever 17 and outer housing 12 are increased to levels far away from the vibration frequency band of the vehicle, thereby preventing the resonance due to the vehicle vibration. Namely, the vibration-withstanding performance of the lock lever 17 can be enhanced, and hence the vibration-withstanding performance of the lever-type connector 10 can be enhanced.

Furthermore, in the lever-type connector of this embodiment, the inner housing 13, urged by the coil springs 16 and 16, abuts against the female connector housing 41. Therefore, the relative motion between the inner housing 13 (holding the female terminals 50) and the female connector housing 41 is directly prevented, so that wear of the contact portions of the female and male terminals 50 and 51 due to the rubbing of these terminals can be reduced. Namely, the vibration-withstanding performance of the lever-type connector 10 can be enhanced.

Furthermore, there is provided the lock lever 17 for supporting the fitting of the female and male connector housings 41 and 11, and therefore the operating force during the fitting operation can be reduced even though the force, required for fitting the female and male connector housings 41 and 11 together, is increased because of the provision of the coil springs 16 and 16.

Furthermore, the pair of side plate portions 17*b* and 17*b* of the lock lever 17 hold the outer housing 12 therebetween, and therefore the frictional forces, preventing the pivotal movement of the lock lever 17, develop at the projections 27 and 27 formed respectively on the side plate portions 17*b* and 17*b*. Therefore, even when the retaining engagement of the retaining engagement point 31 of the lock lever 17 is canceled, the pivotal movement of the lock lever in the returning direction can be limited against the resilience forces of the coil springs 16 and 16. Therefore, the reliability of the lever-type connector 10 can be enhanced without reducing the resilient forces of the coil springs 16 and 16. And besides, the stability of the operation can be enhanced without troubling the operator.

Furthermore, in the lever-type connector 10 of this embodiment, the inner housing 13, urged by the coil springs 16 and 16, abuts at its inclined surfaces 24*a* against the inclined surfaces 45 of the female connector housing 41, and is fixed to the female connector housing 41. The two inclined surfaces 24*a* and 45 intersect the fitting direction, and therefore the relative motion between the inner housing 13 (holding the female terminals 50) and the female connector housing 41 is prevented both in the fitting direction and in the direction perpendicular to the fitting direction, so that wear of the contact portions of the female and male terminals 50 and 51 due to the rubbing of these terminals can be reduced. Namely, the vibration-withstanding performance of the lever-type connector 10 can be enhanced.

The present invention is not limited to the above embodiment, and suitable modifications, improvements and so on can be made. Furthermore, the material, shape, dimensions, numerical value, form, number, disposition, etc., of each of the constituent elements of the above embodiment are arbitrary, and are not limited in so far as the invention can be achieved.

In the above lever-type connector 10, the projections 27 and 27, serving respectively as the points of contact between the lock lever 17 and the outer housing 12, are formed respectively on the pair of side plate portions 17*b* and 17*b* of the lock lever 17. However, instead of this construction, projections, respectively contacting the inner surfaces of the side plate portions 17*b* and 17*b*, can be formed on the outer peripheral surface of the outer housing 12.

Figure 8:
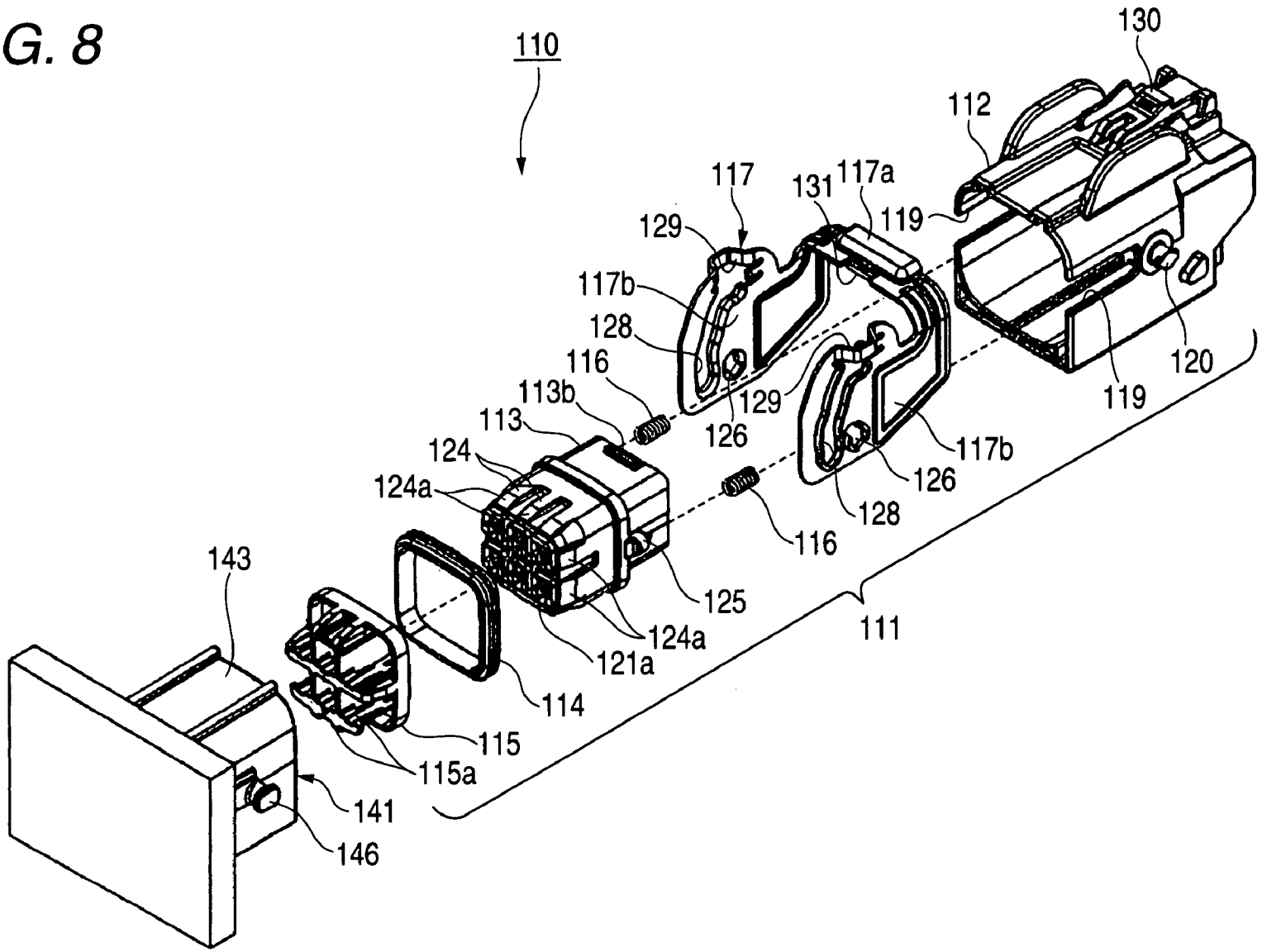
FIG. 8 is an exploded, perspective view of one preferred embodiment of a connector of the present invention.
Figure 9:
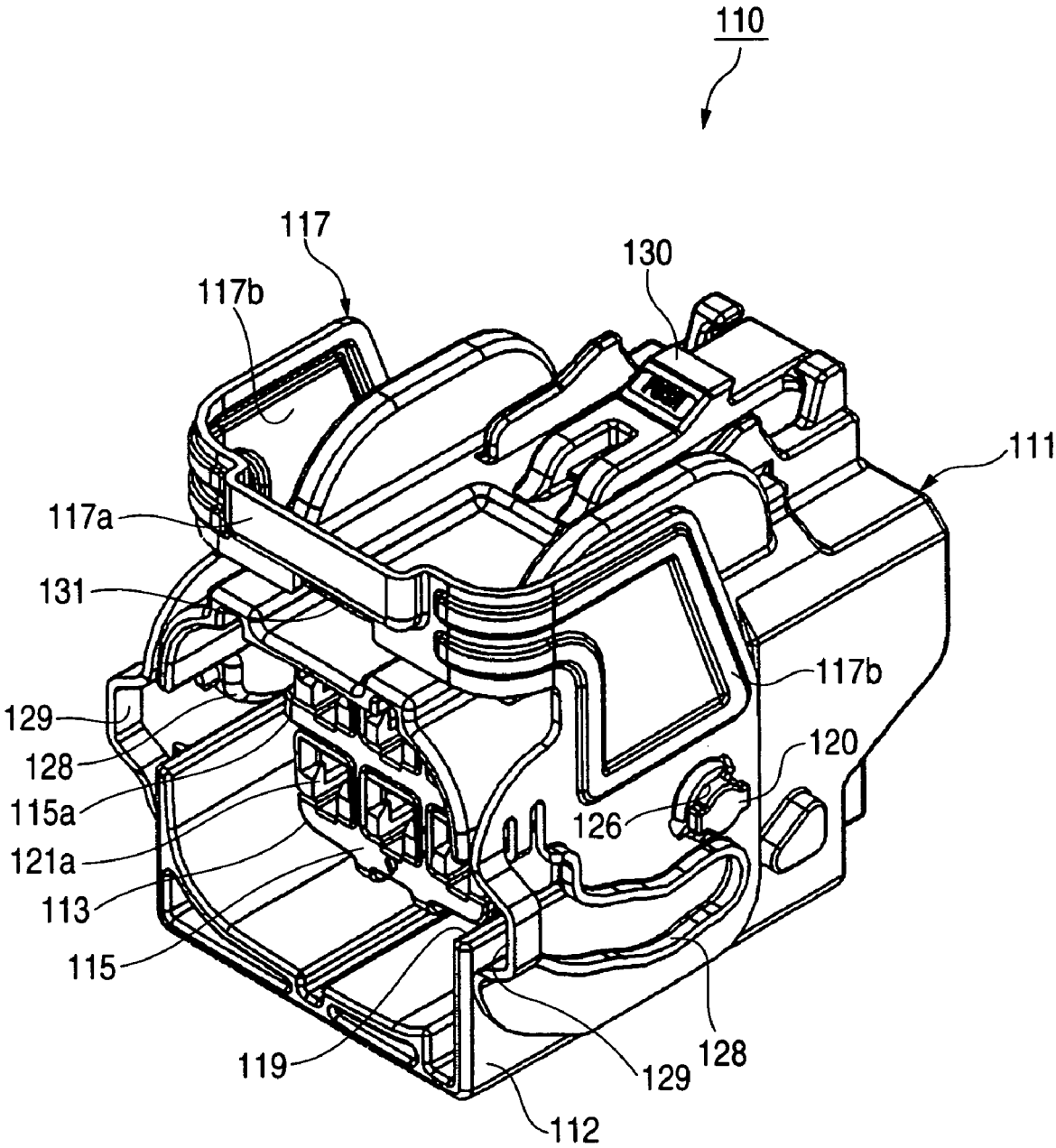
FIG. 9 is a perspective view of a male connector housing of the connector of FIG. 8, showing its appearance.
Figure 10:
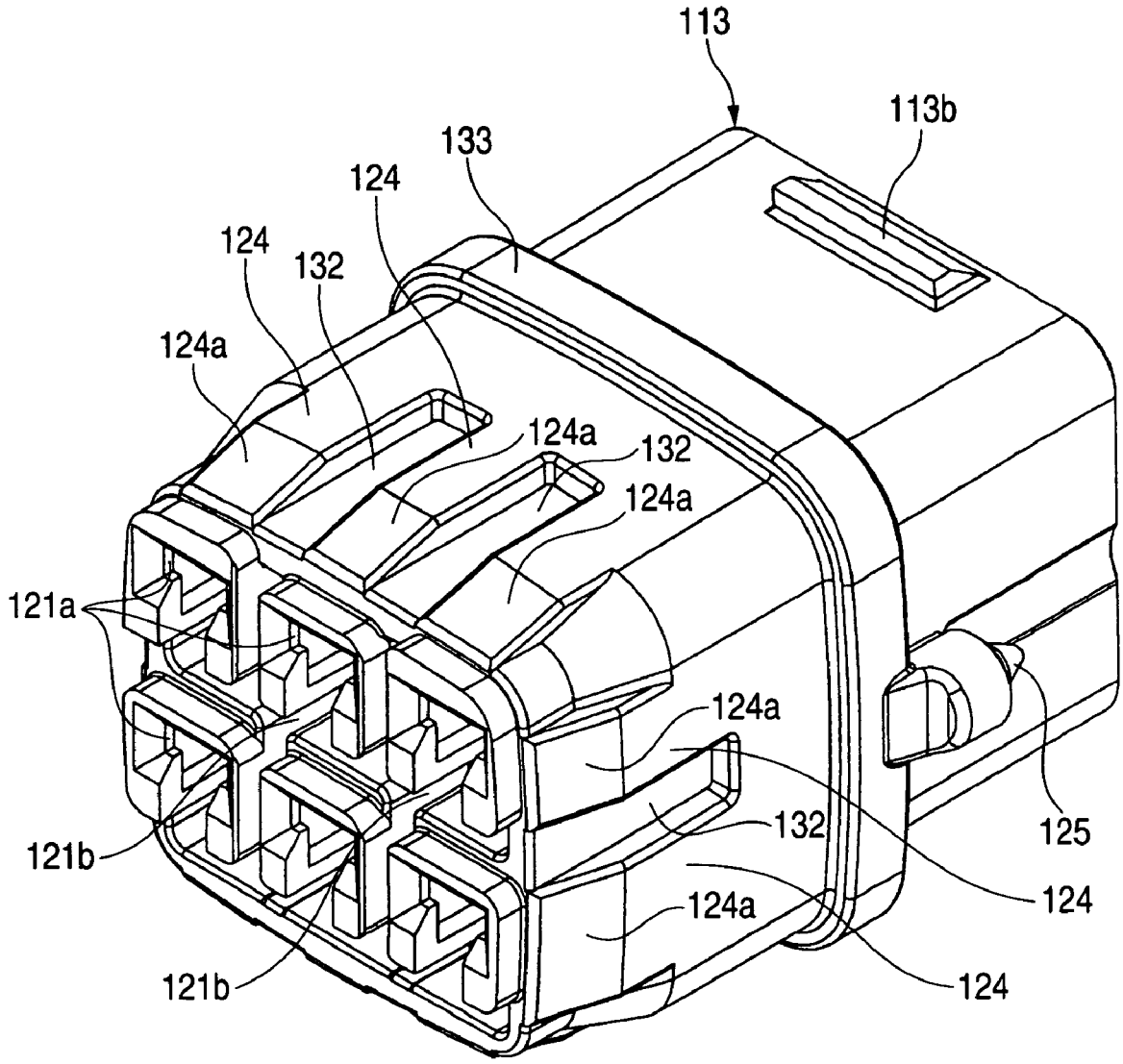
FIG. 10 is a perspective view showing an inner housing of the male connector housing of FIG. 9 alone.
Figure 11:
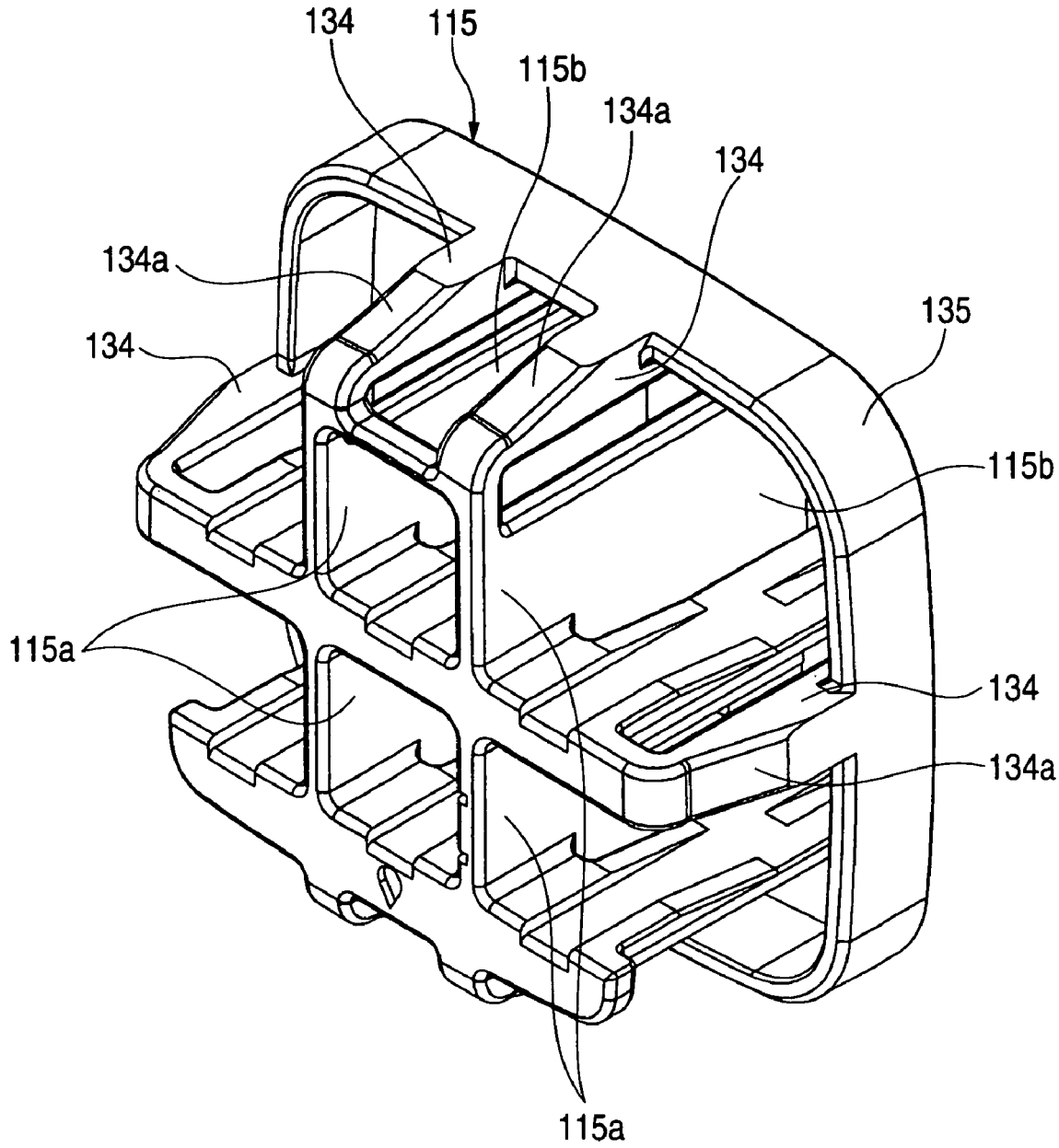
FIG. 11 is a perspective view showing a front holder alone which is to be attached to the inner housing of FIG. 10.
Figure 12:
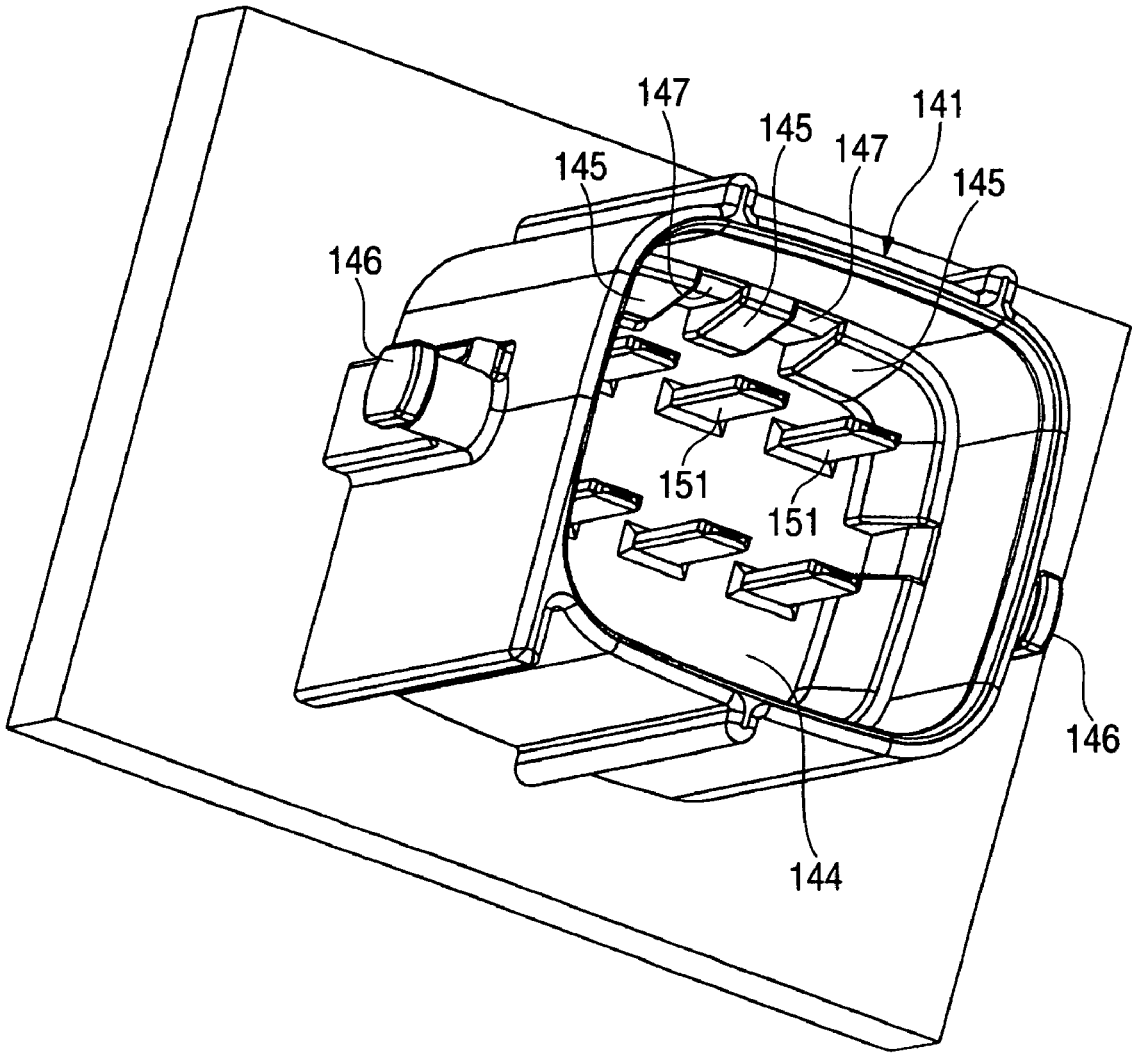
FIG. 12 is a perspective view showing a female connector housing of the connector of FIG. 8 alone.
Figure 13:
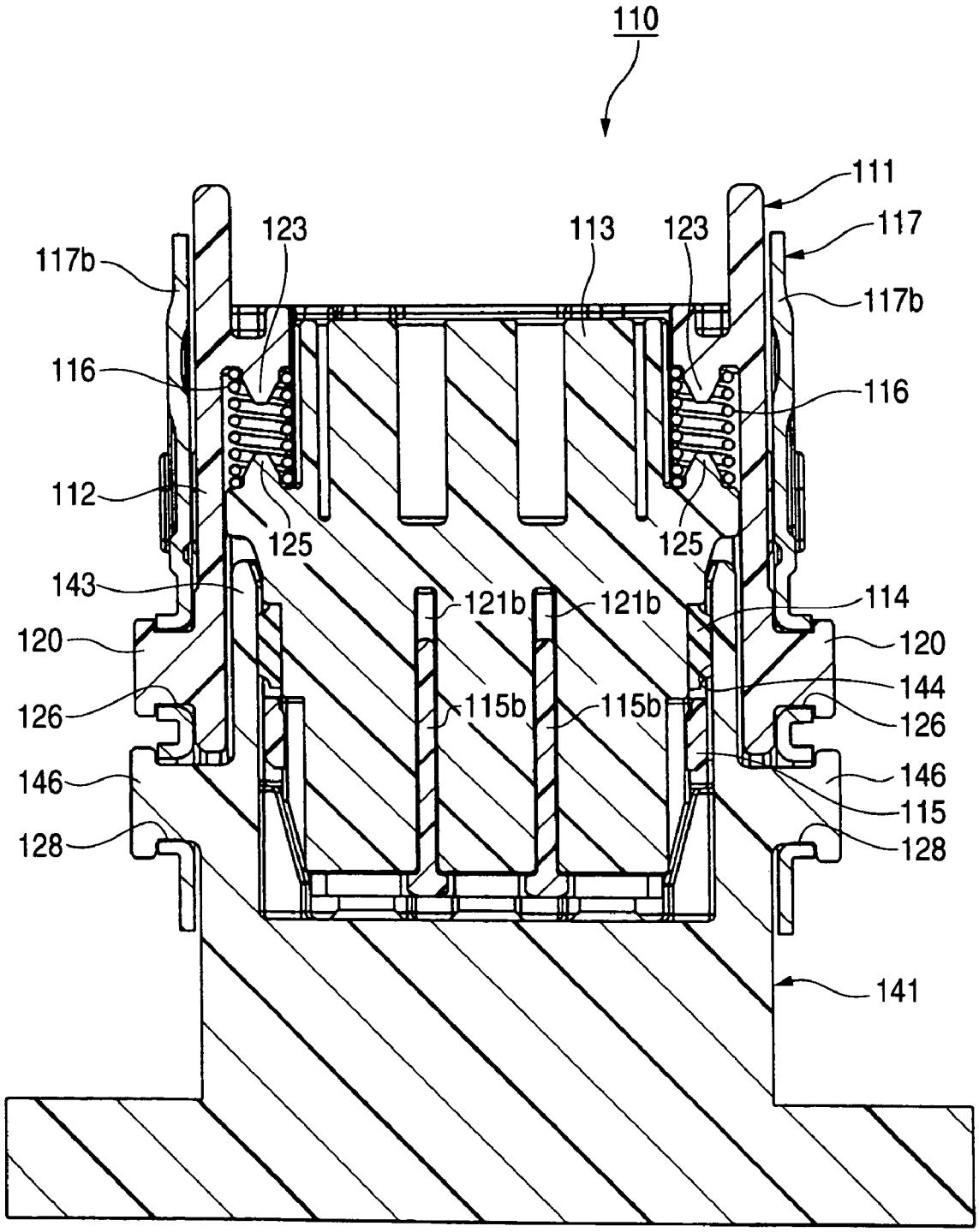
FIG. 13 is a horizontal cross-sectional view of the connector of FIG. 8.
Figure 14:
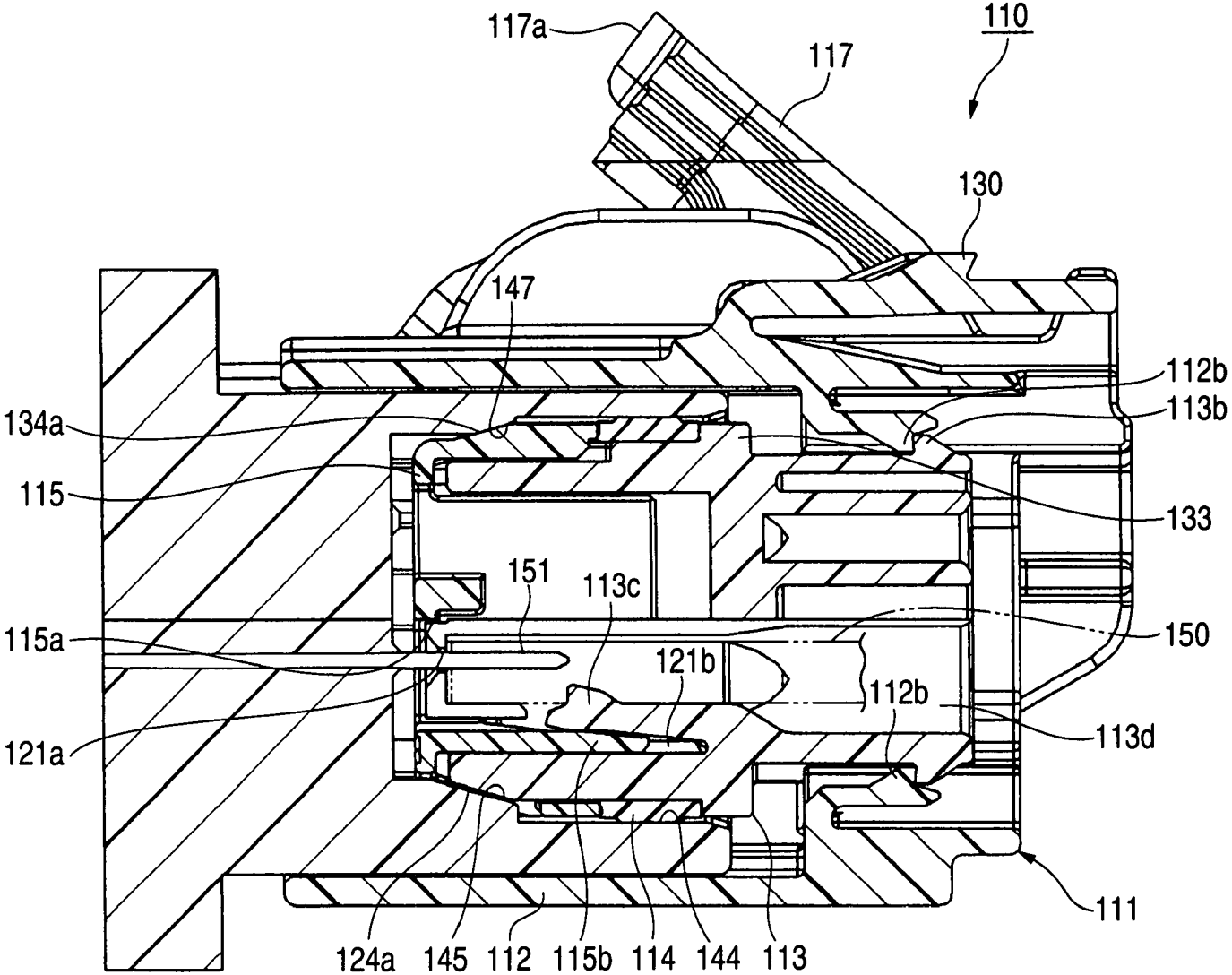
FIG. 14 is a vertical cross-sectional view of the connector of FIG. 9.

FIG. 8 is an exploded, perspective view of one preferred embodiment of the connector of the invention, FIG. 9 is a perspective view of a male connector housing of the connector of FIG. 8, showing its appearance, FIG. 10 is a perspective view showing an inner housing of the male connector housing of FIG. 10 alone, FIG. 11 is a perspective view showing a front holder alone which is to be attached to the inner housing of FIG. 10, FIG. 12 is a perspective view showing a female connector housing of the connector of FIG. 8 alone, FIG. 13 is a horizontal cross-sectional view of the connector of FIG. 8, and FIG. 14 is a vertical cross-sectional view of the connector of FIG. 8.

As shown in FIG. 8, the connector 110 of this embodiment comprises the male connector housing 111, and the female connector housing 141 which can be fitted to the male connector housing 111.

The male connector housing 111 has a lock lever 117 pivotally supported thereon by pivot shafts 120 and 120 formed on the male connector housing 111. The lock lever 117 is a fitting/disengaging operation support member, and when the lock lever 117, engaged with engagement lock projections 146 and 146 of the female connector housing 141, is pivotally moved about the pivot shafts 120 and 120, this lock lever 117 causes the male and female connector housings 111 and 141 to be easily fitted together or withdrawn from each other with a low force, using the principle of the lever. Also, the lock lever 117 can lock the male and female connector housings 111 and 141 in a completely-fitted condition.

The male connector housing 111 comprises an outer housing 112, and the male-type inner housing 113 supported by the outer housing 112 so as to move forward and rearward in the connector fitting direction within the outer housing 112.

Referring to FIG. 14, the inner housing 113 has terminal receiving chambers 113*d* formed therein for respectively receiving female terminals 150. Each female terminal 150, received in the terminal receiving chamber 113*d*, is provisionally retained by an elastic retaining lance 113*c* formed within the terminal receiving chamber 113*d*, and is held in this chamber 113*d*.

The male connector housing 111 further comprises the front holder (movable member) 115 for completely retaining the female terminals 150 (provisionally retained in the respective terminal receiving chambers 113*d*) in the respective terminal receiving chambers 113*d*, an annular rubber packing 114 serving as an elastic seal member, and a pair of metal coil springs 116 and 116. On the other hand, the female connector housing 141 holds male terminals 151.

Here, for convenience of explanation, the front and rear sides, the upper and lower sides and the right and left sides will be defined as follows. The forward-rearward direction is defined as the connector fitting direction, and the fitting ends of the male and female connector housings 111 and 141 are defined as "the front side", while the other ends thereof are defined as "the rear side". The direction of juxtaposition of the pivot shafts 120, as well as the direction of juxtaposition of the engagement lock projections 146, is defined as the right-left direction. That side where an operating portion 117*a* of the lock lever 117 is disposed is defined as "the upper side", while the opposite side is defined as "the lower side".

The outer housing 112 as well as the inner housing 113 is formed by injection molding a synthetic resin material. As shown in FIGS. 8 and 9, the outer housing 112 is formed into a generally square tubular shape, and is open at its front side. The inner housing 113 is disposed within the outer housing 112 so as to move forward and rearward in the connector fitting direction. An outer peripheral wall of a front portion of the outer housing 112 surrounds the inner housing 113 over an entire periphery thereof, with a gap formed therebetween, and functions as a hood for guiding a hood portion 143 of the female connector housing 141 fitted into this annular gap.

As shown in FIGS. 8, 11 and 14, the inner housing 113 has a pair of engagement projections 113*b* formed respectively on upper and lower portions of a rear end portion of an outer peripheral surface thereof. On the other hand, the outer housing 112 has a pair of cantilever-like retaining projections 112*b* formed on and extending rearwardly respectively from upper and lower portions of an inner peripheral surface of a rear portion thereof. The engagement projections 113*b* of the inner housing 113 are retained respectively by the retaining projections 112*b* within the outer housing 112, so that the inner housing 113 is prevented from moving forward relative to the outer housing 112 in an amount exceeding a predetermined value. Thus, the male connector housing 111 has a forward-withdrawal prevention mechanism (that is, the engagement projections 113*b* and the retaining projections 112*b*) for preventing the forward withdrawal of the inner housing 113 from the outer housing 112 in the connector fitting direction.

As shown in FIG. 8, slit-like lock projection-receiving portions 119 are formed respectively in opposed right and left side portions of the outer peripheral wall of the outer housing 112, and extend in the connector fitting direction. The pivot shafts 120 are formed integrally on the outer peripheral wall of the outer housing 112, and are disposed respectively on lines of extension of the lock projection-receiving portions 119. As shown in FIG. 13, spring support portions 123 and 123 for respectively supporting rear end portions of the pair of coil springs 116 and 116 are formed respectively on right and left side portions of the inner peripheral surface of the rear portion of the outer housing 112.

As shown in FIGS. 10 and 14, a plurality of receiving chamber openings 121*a* for being aligned respectively with male terminal insertion holes 115*a* in the front holder 115 are formed in the front surface of the inner housing 113, and also insertion holes 121*b* for respectively receiving partition plate portions 115*b* of the front holder 115 are formed in the front surface of the inner housing 113. The receiving chamber openings 121*a* of the inner housing 113 communicate respectively with the terminal receiving chambers 113*d*. When the male connector housing 111 and the female connector housing 141 are fitted together, an electrical contact portion of each of the male terminals 151 of the female connector housing 141 is guided into the corresponding terminal receiving chamber 113*d* through the corresponding male terminal insertion hole 115*a* of the front holder 115 and the corresponding receiving chamber opening 121*a* of the inner housing 113, and is brought into contact with an electrical contact portion of the female terminal 150 disposed within this terminal receiving chamber 13*d*, and therefore is electrically connected thereto.

As shown in FIG. 10, a plurality of relative motion limitation portions 124 are formed on and project from the outer peripheral surface of a front portion of the inner housing 113, and are spaced from one another in the direction of the periphery thereof. The relative motion limitation portions 124 have respective inclined surfaces 124*a* each inclined from its rear end toward its front end in a manner to gradually approach an axis of the inner housing 113. When the male connector housing 111 and the female connector housing 141 are completely fitted together, the inclined surfaces 124*a* are held in surface-to-surface contact with respective inclined surfaces 145 formed on an inner peripheral surface of the hood portion 143 of the female connector housing 141, as shown in FIG. 14.

As shown in FIGS. 10 and 13, spring support portions 125 and 125 for respectively supporting front end portions of the pair of coil springs 116 and 116 are formed at the rear portion of the inner housing 113, and are so disposed as to be opposed respectively to the spring support portions 123 and 123 of the outer housing 112.

As shown in FIG. 11, the front holder 115 includes the plurality of partition plate portions 115*b* intersecting one anther in a grid-like manner to separate the plurality of male terminal insertion holes 115*a* from one another in a grid-like pattern, a frame portion 135 of a generally rectangular shape surrounding the plurality of partition plate portions 115*b*, and a plurality of interconnecting piece portions 134 integrally connecting front end portions of the respective partition plate portions 115*b* to the frame portion 135. Inclined surfaces 134*a* are formed respectively on outer surfaces of the interconnecting piece portions 134, and each of these inclined surfaces 134*a* is inclined from its rear end toward its front end in a manner to gradually approach the axis of the inner housing 113. When the male connector housing 111 and the female connector housing 141 are completely fitted together, the inclined surfaces 134*a* are held in surface-to-surface contact with respective inclined surfaces 147 formed on the inner peripheral surface of the hood portion 143 of the female connector housing 141, as shown in FIG. 14.

The front holder 115 is attached to the inner housing 113 in such a manner that the frame portion 135 is fitted on the front portion of the inner housing 113 (having the plurality of relative motion limitation portions 124 formed in a projected manner thereon), with the interconnecting piece portions 134 inserted in respective recess portions 132 (see FIG. 10) each formed between the adjacent relative motion limitation portions 124 and 124 juxtaposed in the direction of the periphery of the inner housing 113. Thus, the front holder 115 is supported on the inner housing 113 so as to move forward and rearward in the fitting direction. When the front holder 115 is thus attached to the inner housing 113, the inclined surfaces 134*a*, formed respectively on the interconnecting piece portions 134 of the front holder 115, and the inclined surfaces 124*a*, formed respectively on the relative motion limitation portions 124 of the inner housing 113, are disposed on the outer periphery surrounding contact points of the female terminals 150 for contact with the respective male terminals 151, as shown in FIG. 14.

As shown in FIG. 10, an annular projection 133 is formed on the outer peripheral surface of the inner housing 113, and when the front holder 115 is attached to the inner housing 113, this annular projection 133 is spaced a predetermined distance from a rear end of the frame portion 135 of the front holder 115. The rubber packing 114 is interposed between the annular projection 133 and the frame portion 135 of the front holder 115. The rubber packing 114 is made of an elastic material such as synthetic rubber or an elastomeric resin, and is formed into a generally elliptic tubular shape so as to closely fit on the outer peripheral surface of the inner housing 113.

The lock lever 117 is made of metal, a synthetic resin or any other suitable material. As shown in FIG. 8, the lock lever 117 includes the operating portion 17*a*, and side plate portions 117*b* and 117*b* bent generally perpendicularly respectively at opposite (right and left) ends of the operating portion 117*a*, and this lock lever 117 has a generally U-shaped cross-section. The outer housing 112 is interposed between the side plate portions 117*b* and 117*b* of the lock lever 117.

The operating portion 117*a* has a retaining engagement portion 131 for retaining engagement with a retaining portion 130 formed on an upper portion of the outer peripheral surface of the rear portion of the outer housing 112. Each of the side plate portions 117*b* has a mounting hole 126 rotatably (or angularly movably) fitted on the corresponding pivot shaft 120 of the outer housing 112, and also has a generally arcuate lock groove 128. The lock grooves 128 are open at their one longitudinal ends so that the engagement lock projections 146, formed respectively on the right and left side surfaces of the hood portion 143 of the female connector housing 141, can be easily inserted into these lock grooves 128, respectively. More specifically, in order that each engagement lock projection 146 can be easily inserted into the corresponding lock groove 128, a lock projection introduction port 129 is formed by bulging part of each side plate portion 117*b* outwardly, and is disposed in communication with the open end of the lock groove 128.

As shown in FIG. 12, the female connector housing 141 has a connector fitting chamber 144 of a closed-bottom tube-shape formed within the hood portion 143, the connector fitting chamber 144 having an open front side. The inclined surfaces 145 are formed respectively on those portions of the inner peripheral surface of the hood portion 143 (forming the connector fitting chamber 144) which are to be opposed respectively to the inclined surfaces 124*a* (formed respectively on the relative motion limitation portions 124 of the inner housing 113) in the fitting direction, and these inclined surfaces 145 can be mated respectively with the inclined surfaces 124*a*. Also, the inclined surfaces 147 are formed respectively on those portions of the inner peripheral surface of the hood portion 143 which are to be opposed respectively to the inclined surfaces 134*a* (formed respectively on the interconnecting piece portions 134 of the front holder 115) in the fitting direction, and these inclined surfaces 147 can be mated respectively with the inclined surfaces 134*a*. When the male connector housing 111 and the female connector housing 141 are fitted together, the inclined surfaces 145 abut respectively against the inclined surfaces 124*a* of the relative motion limitation portions 124 of the inner housing 113, and also the inclined surfaces 147 abut respectively against the inclined surfaces 134*a* of the interconnecting piece portions 134 of the front holder 115. The inclined surfaces 145 and 147 are formed on the inner peripheral surface of the hood portion 143 (which forms the connector fitting chamber 144) at the same inclination angle as the inclination angle of the inclined surfaces 124*a* and 134*a*.

Next, a method of assembling the male connector housing 111 will be described. The female connector housing 141 can be formed by insert molding the male terminal 151 in a housing body, and therefore a detailed description of its assembling method will be omitted. However, suitable terminal receiving chambers may be formed within the female connector housing 141, in which case male terminals 151 are retained by suitable retaining means such as elastic retaining lances formed within the respective terminal receiving chambers.

The male connector housing 111 is assembled in the following manner. The rubber packing 114 is mounted on the front portion of the inner housing 113 having the female terminals 150 received in the respective terminal receiving chambers 113*d*, and the front holder 115 is attached to the inner housing 113 in such a manner that the partition plate portions 115*b* of the front holder 115 are inserted into the respective insertion holes 121*b* of the inner housing 113. As a result of attaching the front holder 115 to the inner housing 113, the female terminals 150 are retained in a double manner within the respective terminal receiving chambers 113*d*, and also the rubber packing 114 is prevented from forward withdrawal from the inner housing 113.

Then, the front end portions of the coil springs 116 are attached respectively to the spring support portions 125 from the rear side of the inner housing 113, and the inner housing 113 is fitted into the outer housing 112 in such a manner that the rear end portions of the coil springs 116 are attached respectively to the spring support portions 123 of the outer housing 112.

Then, the inner housing 113 is pushed deeper into the outer housing 112 against the resiliency (that is, resilient restoring forces) of the coil springs 116, and when the engagement projections 113*b* of the inner housing 113 are engaged respectively with the retaining projections 112*b* of the outer housing 112, the coil springs 116 are held between the inner housing 113 and the outer housing 112. In this manner, the inner housing 113 is mounted within the outer housing 112. When the inner housing 113 and the outer housing 112 are thus completely assembled together, the coil springs 116 may or may not be compressed by the inner housing 113 and the outer housing 112.

Then, the lock lever 117 is moved close to the rear side of the outer housing 112, and when the outer housing 112 is inserted between the pair of side plate portions 117*b* and 117*b* of the lock lever 117 (in such a manner that the outer housing 112 is interposed between the side plate portions 117*b* and 117*b*), end edges of the side plate portions 117*b* and 117*b* abut respectively against the pivot shafts 120 and 120, and the side plate portions 117*b* and 117*b* are temporarily bent outwardly, and when the mounting holes 126 and 126 are brought into registry with the right and left pivot shafts 120 and 120, the pivot shafts 120 and 120 become engaged in the respective mounting holes 126 and 126. The lock lever 117 is thus mounted on the outer housing 112, so that the assembling of the male connector housing 111 is finished.

The lock lever 117 is thus mounted on the outer housing 112 so as to be pivotally moved about the pivot shafts 120 in the forward and rearward directions. The lock lever 117 can be switched between an unlocked position (shown in FIGS. 9 and 10A) where the operating portion 117*a* is disposed in an upstanding condition, that is, the plane of the operating portion 117*a* is disposed generally perpendicular to the upper surface of the outer housing 112 and a locked position (shown in FIG. 15B) where the operating portion 117*a* is disposed in a rearwardly-downed condition, that is, the plane of the operating portion 117*a* is disposed generally parallel to the upper surface of the outer housing 112.

Figure 15:
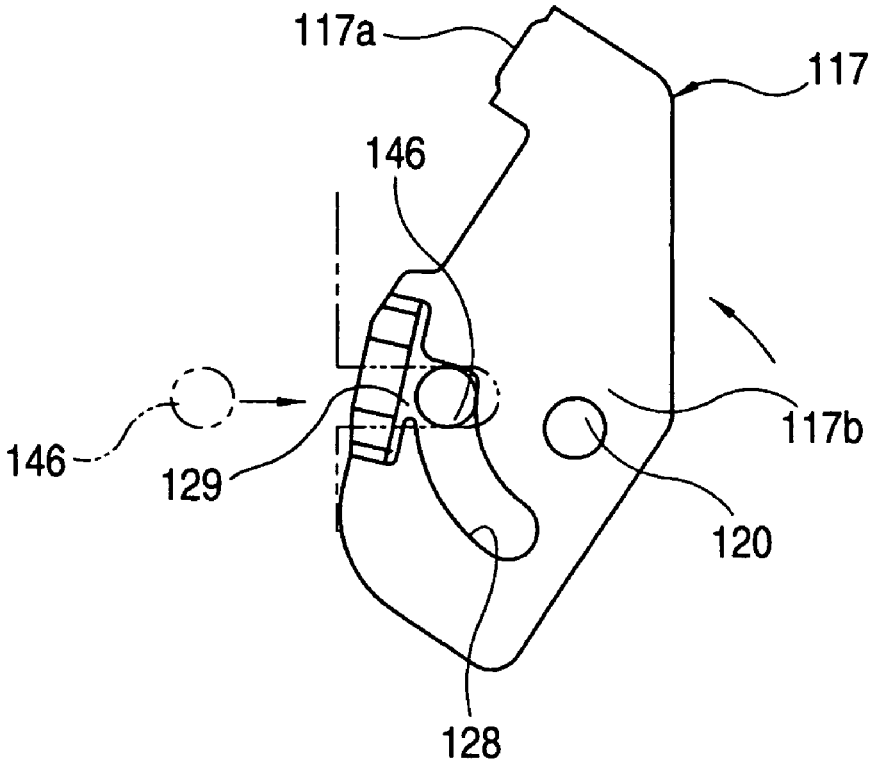
FIGS. 15A and 15B are views explanatory of an operation of a fitting/disengaging operation support mechanism of the connector of FIG. 8.
Figure 15:
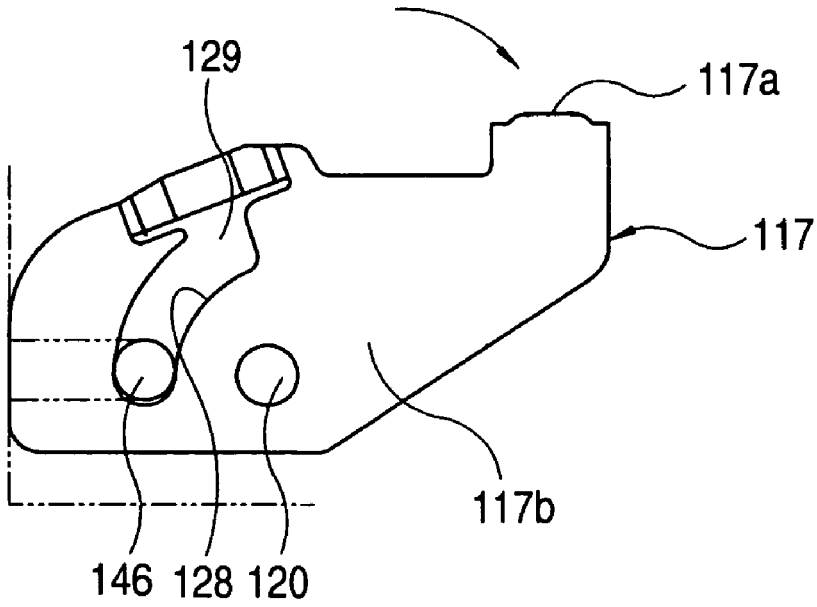

FIGS. 15A and 15B are views explanatory of the operation of the fitting/disengaging operation support mechanism of the connector 110. As is clear from FIG. 15A, when the lock lever 117 is disposed in the upstanding condition, that is, in the unlocked position, each lock projection introduction port 129 is open forward, that is, toward the female connector housing 141 when the male connector housing 111 and the female connector housing 141 are to be fitted together.

Next, a method of fitting the connector 110 will be described.

The lock lever 117 of the male connector housing 111 is disposed in the unlocked position as shown in FIG. 15A, and in this condition, when the hood portion 143 of the female connector housing 141 is fitted into the annular space between the outer housing 112 and the inner housing 113, the inner housing 113 is also fitted into the connector fitting chamber 144 of the female connector housing 141. At this time, the engagement lock projections 146 of the female connector housing 141 enter the respective lock projection-receiving portions 119 of the outer housing 112, and then are brought into the open ends of the respective lock grooves 128 through the respective lock projection introduction ports 129. FIG. 15A shows this condition, and the male connector housing 111 and the female connector housing 141 are disposed in a half-fitted condition.

Then, when the lock lever 117 is pivotally moved about the pivot shafts 120 by pushing the operating portion 117*a* rearwardly, and therefore is turned from the unlocked position (shown in FIG. 15A) toward the rear locked position, each engagement lock projection 146, while guided by the corresponding lock groove 128, moves in and along this lock groove 128 from the open end thereof toward the other end thereof, so that the operation for fitting the male and female connector housings 111 and 141 together proceeds. At this time, first, the inclined surfaces 147, provided at the inner portion of the connector fitting chamber 144, abut against the respective inclined surfaces 134*a* of the interconnecting piece portions 134 of the front holder 115, so that the rubber packing 114, interposed between the frame portion 135 of the front holder 115 and the annular projection 133 of the inner housing 113, is compressed. In this condition, the operating portion 117*a* is further pushed rearwardly to pivotally move the lock lever 117, so that the inclined surfaces 145, provided at the inner portion of the connector fitting chamber 144, abut against the respective inclined surfaces 124*a* of the relative motion limitation portions 124. In this condition, the operating portion 117*a* is further pushed rearwardly to pivotally move the lock lever 117, and when the lock lever 117 reaches the locked position shown in FIG. 15B, the male connector housing 111 and the female connector housing 141 are completely fitted together, and within these connector housings, the inclined surfaces 124*a* are pressed by the respective inclined surfaces 145, and also the inclined surfaces 134*a* are pressed by the respective inclined surfaces 147, so that the coil springs 116 are compressed. The coil springs 116 are higher in elastic coefficient than the rubber packing 114.

In this connector completely-fitted condition, the male connector housing 111 and the female connector housing 141 are locked to each other against disengagement by the connector fitting/disengaging operation support mechanism including the lock lever 117, and this fitted condition is maintained, and therefore the inclined surfaces 145 of the female connector housing 141 are urged by the resilient restoring forces of the coil springs 116 through the respective inclined surfaces 124*a* of the relative motion limitation portions 124, and also the inclined surfaces 147 of the female connector housing 141 are urged by the elastic restoring force of the rubber packing 114 through the respective inclined surfaces 134*a* of the front holder 115. Furthermore, in this connector completely-fitted condition, the flat plate-shaped electrical contact portions of the male terminals 151 are inserted respectively in the box-shaped electrical contact portions of the female terminals 150, and the electrical contact portions of the female terminals 150 are electrically connected respectively to the electrical contact portions of the male terminals 151. Furthermore, in this connector completely-fitted condition, the rubber packing 114 is held between (or gripped by) the inner peripheral surface of the connector fitting chamber 144 of the female connector housing 141 and the outer peripheral surface of the inner housing 113, and forms a liquid-tight seal between this inner peripheral surface and this outer peripheral surface.

With respect to the operation for disengaging the male connector housing 111 and the female connector housing 141 from each other, the retaining engagement of the retaining engagement portion 131 of the operating portion 117*a* with the retaining portion 130 of the outer housing 112 is canceled, and then the lock lever 117 is pivotally moved in a direction opposite to the direction of pivotal movement of the lock lever 117 during the fitting operation, thereby effecting this connector disengaging operation.

In the lever-type connector 110 of this embodiment, the inclined surfaces of the inner housing 113 are formed on both of the relative motion limitation portions 124 of the inner housing 113 and the interconnecting piece portions 134 of the front holder 115 urged forward in the fitting direction by the rubber packing 114. Even when a dimensional error develops in the inclined surfaces 124*a* (formed respectively on the relative motion limitation portions 124 of the inner housing 113) and the inclined surfaces 145 (formed on the inner peripheral surface of the female connector housing 141), so that the mating inclined surfaces 124*a* and 145 fail to fully contact each other over their entire areas, thus reducing the area of contact therebetween, the inclined surfaces 134*a*, formed on the respective interconnecting piece portions 134 of the front holder 115, never fail to contact the respective inclined surfaces 147 formed on the inner peripheral surface of the female connector housing 141, thereby compensating for the reduced contact area. Therefore, the relative motion between the female connector housing 141 and the inner housing 113 is positively prevented, so that wear of the contact points of the female and male terminals due to vibration can be reduced.

Furthermore, in the connector 110 of this embodiment, the operation for preventing the relative motion between the female connector housing 141 and the inner housing 113 is effected in the vicinity of the contact points of the female and male terminals 150 and 151, and therefore wear of the contact points of the female and male terminals 151 and 150 due to vibration can be more positively reduced.

Furthermore, in the connector 10 of this embodiment, the rubber packing 114 is disposed rearwardly of the inclined surfaces 124*a* and 134*a* (for preventing the relative motion) in the fitting direction, that is, disposed at the inner region remote from the open end of the outer housing 112, and therefore damage to the rubber packing 114, as well as the deposition of foreign matters on the rubber packing 114, can be reduced, thereby enhancing the sealing performance of the rubber packing 114.

The present invention is not limited to the above embodiment, and suitable modifications, improvements and so on can be made. Furthermore, the material, shape, dimensions, numerical value, form, number, disposition, etc., of each of the constituent elements of the above embodiment are arbitrary, and are not limited in so far as the invention can be achieved.

What is claimed is:

1. A lever-type connector assembly, comprising:

a pair of connector housings, which have respective connector terminals, the pair of connector housings comprising one connector housing and another connector housing, the one connector housings provided with a lever pivotally supported thereon at a pivot point, the other connector housing provided with engagement projections engaged with the lever, the lever being engaged with the engagement projections and being pivotally moved so as to fit the pair of connector housings together;

wherein the lever has at least one lever contact point at which the lever contacts the one connector housing at a connector housing contact point, the at least one lever contact point location being displaced from the pivot point, wherein at least one of said lever contact point and said connector housing contact point is a projection which contacts the other of said lever contact point and said connector housing contact point;

wherein the lever comprises:

a pair of opposed side plate portions between which the one connector housing is interposed, and which are pivotally supported at their one end portions on the one connector housing; and an operating portion which interconnects the other end portions of the pair of side plate portions and is operable to be pivotally operated;

wherein the at least one lever contact point comprises two lever contact points;

wherein the lever contact points are disposed respectively on those portions of the pair of side plate portions which are opposed to each other; and the pair of side plate portions hold the one connector housing therebetween at the lever contact points.

2. A lever-type connector assembly, comprising:

a pair of connector housings, which have respective connection terminals, the pair of connector housings comprising one connector housing and another connector housing, the one connector housing provided with a level pivotally supported thereon at a pivot point, the other connector housing provided with engagement projections engaged with the lever, the lever being engaged with the engagement projections and being pivotally moved so as to fit the pair of connector housings together;

wherein the lever has at least one lever contact point at which the lever contacts the one connector housing at a connector housing contact point, the at least one lever contact point location being displaced from the pivot point, wherein at least one of said lever contact point and said connector housing contact point is a projection which contacts the other of said lever contact point and said connector housing contact point, wherein the one connector housing comprises:

an inner housing, which holds the connection terminal, and can be fitted in the other connector housing;

an outer housing which surrounds an outer periphery of the inner housing, and supports the inner housing in such a manner that the inner housing can move forward and rearward in a fitting direction; and a resilient member which is interposed between the inner housing and the outer housing to urge the inner housing toward the other connector housing; and wherein the lever is pivotally supported on the outer housing.

3. The lever-type connector according to claim 2, wherein: inclined surfaces which intersect the fitting direction and can be mated with each other, are formed respectively on the inner housing and the other connector housing.

4. A connector, comprising:

a female connector housing, holding a male terminal; and a male connector housing, receiving a female terminal for electrical connection to the male terminal; the male connector housing comprising;

a male-type inner housing, holding the female terminal, and can be fitted in the female connector housing so that the female terminal can be connected to the male terminal, an outer housing, surrounding an outer periphery of the inner housing, and supports the inner housing such that the inner housing can move forward and rearward in a fitting direction; and a first resilient member, interposed between the inner housing and the outer housing to urge the inner housing forward in the fitting direction; and a movable member, mounted on an outer peripheral surface of the inner housing so as to move forward and rearward in the fitting direction, and a second resilient member, mounted on the outer peripheral surface of the inner housing, and urging the movable member forward in the fitting direction by an urging force different from an urging force of the first resilient member; wherein first inclined surfaces, inclined to intersect the fitting direction, are formed on the movable member and that portion of the outer peripheral surface of the inner housing, disposed on the same periphery as the periphery of the movable member, and are arranged over the entire periphery; and first inclined surfaces, which are mated respectively with the inclined surfaces formed on the movable member and the outer peripheral surface of the inner housing, are formed on an inner peripheral surface of the female connector housing over an entire periphery thereof.

5. The connector according to claim 4, wherein the first inclined surfaces are disposed on the outer periphery surrounding a contact point of the female terminal.

6. The connector according to claim 4, wherein the second resilient member, urging the movable member, is an elastic seal member which is interposed between the outer peripheral surface of the inner housing and the inner peripheral surface of the female connector housing to form a seal therebetween; and the elastic seal member is disposed rearwardly of the first inclined surfaces in the fitting direction.

* * * * *